US011446208B2

(12) United States Patent
Kato et al.

(10) Patent No.: US 11,446,208 B2
(45) Date of Patent: Sep. 20, 2022

(54) DRUG SOLUTION PREPARATION APPARATUS

(71) Applicant: JMS CO., LTD., Hiroshima (JP)

(72) Inventors: Hidetoshi Kato, Hiroshima (JP); Atsushi Kimura, Hiroshima (JP)

(73) Assignee: JMS Co., Ltd., Hiroshima (JP)

( * ) Notice: Subject to any disclaimer, the term of this patent is extended or adjusted under 35 U.S.C. 154(b) by 451 days.

(21) Appl. No.: 16/633,496

(22) PCT Filed: Jul. 23, 2018

(86) PCT No.: PCT/JP2018/027438
§ 371 (c)(1),
(2) Date: Jan. 23, 2020

(87) PCT Pub. No.: WO2019/021985
PCT Pub. Date: Jan. 31, 2019

(65) Prior Publication Data

US 2021/0128411 A1 May 6, 2021

(30) Foreign Application Priority Data

Jul. 25, 2017 (JP) ..... JP2017-143849
Jul. 25, 2017 (JP) ..... JP2017-143851

(51) Int. Cl.
*A61J 1/20* (2006.01)
*A61J 3/00* (2006.01)

(52) U.S. Cl.
CPC .. *A61J 1/20* (2013.01); *A61J 3/00* (2013.01)

(58) Field of Classification Search
CPC ..... A61M 5/1782; A61M 2039/226; A61M 2039/229; A61J 1/2096; A61J 1/20; A61J 3/00; A61J 1/2062
See application file for complete search history.

(56) References Cited

U.S. PATENT DOCUMENTS

2011/0100501 A1* 5/2011 Mizuno ..... A61J 3/002 141/2
2012/0071828 A1* 3/2012 Tojo ..... A61J 1/2096 604/131

(Continued)

FOREIGN PATENT DOCUMENTS

EP 2 298 270 3/2011
JP 3-099231 4/1991

(Continued)

OTHER PUBLICATIONS

Extended European Search Report issued in corresponding European Patent Application No. 18838305.3, dated Apr. 22, 2021, 8 pages.

(Continued)

*Primary Examiner* — Catharine L Anderson
*Assistant Examiner* — Arjuna P Chatrathi
(74) *Attorney, Agent, or Firm* — Hamre, Schumann, Mueller & Larson, P. C.

(57) ABSTRACT

A device holder (20) that holds a transfer device (800) is provided on a stage (10). The device (800) includes a first connector (810) to which a first container (910) is connectable, a second connector (820) to which a second container (950) is connectable, and a connection port (850) to which a syringe (980) is connectable. The stage (10) can be turned to a first turning position where the first connector (810) is located higher than the second connector (820) and a second turning position where the second connector (820) is located higher than the first connector (810). A second container holder (50) that holds the second container (950) coaxially with the second connector (820) turns together with the stage (10) and can be linearly moved along a direction of an axis of the second connector (820).

19 Claims, 14 Drawing Sheets

(56) References Cited

U.S. PATENT DOCUMENTS

| | | | | |
|---|---|---|---|---|
| 2012/0197184 | A1 | 8/2012 | Okuda et al. | |
| 2012/0241043 | A1 | 9/2012 | Perazzo et al. | |
| 2015/0083950 | A1 | 3/2015 | Okiyama | |
| 2015/0202425 | A1 | 7/2015 | Yamamoto | |
| 2015/0251778 | A1 | 9/2015 | Tachibana et al. | |
| 2015/0251781 | A1* | 9/2015 | Matsukuma | A61J 1/20 141/2 |
| 2015/0265499 | A1 | 9/2015 | Takeuchi | |
| 2015/0366758 | A1 | 12/2015 | Noguchi et al. | |
| 2017/0027820 | A1 | 2/2017 | Okiyama et al. | |
| 2017/0129763 | A1* | 5/2017 | Fangrow, Jr. | B67D 7/0294 |
| 2017/0135903 | A1* | 5/2017 | Wattelier | A61J 1/2068 |

FOREIGN PATENT DOCUMENTS

| | | |
|---|---|---|
| JP | 2015-167644 | 9/2015 |
| JP | 2015-167645 | 9/2015 |
| WO | 2011/033788 | 3/2011 |
| WO | 2013/161979 | 10/2013 |
| WO | 2014/020692 | 2/2014 |
| WO | 2014/061661 | 4/2014 |
| WO | 2014/104027 | 7/2014 |
| WO | 2015/166993 | 11/2015 |

OTHER PUBLICATIONS

Office Action issued in corresponding Japanese Patent Application No. 2017-143849, dated May 6, 2021, 10 pages w/translation.
Office Action issued in corresponding Japanese Patent Application No. 2017-143851, dated May 6, 2021, 8 pages w/translation.

* cited by examiner

DRUG SOLUTION PREPARATION APPARATUS

TECHNICAL FIELD

The present invention relates to an apparatus that is used when preparing a drug solution.

BACKGROUND ART

In a case in which a drug in the form of powder enclosed in a vial is to be administered to a patient, a drug solution preparation task is performed in which a drug solution obtained by dissolving the drug is transferred to a drug solution bag. If the drug is a dangerous drug such as an anticancer drug, it is necessary to prevent a situation in which the drug leaks to the outside and the operator is exposed to the drug. Therefore, the drug solution is prepared within a safety cabinet to prevent the drug from dispersing to the outside. Further, in some cases, the vial and the drug solution bag are connected to each other via a "closed system device".

As one example of the closed system device, Patent Document 1 describes a transfer device (hereinafter simply referred to as a "device", which is called a "medical connector" in Patent Document 1) that is connected between a vial and a drug solution bag and configured to transfer a drug solution between the vial and the drug solution bag using a closed system. This device includes a first connector that is connected to the drug solution bag, a second connector that is connected to the vial, and a tubular portion that is provided between the first connector and the second connector. A stopcock is inserted into one end of the tubular portion. A syringe is connected to the other end of the tubular portion. The stopcock is rotatable relative to the tubular portion. A plurality of channels are formed in the stopcock, and the state of communication between the drug solution bag, the vial, and the syringe can be switched by rotating the stopcock.

Generally, a drug solution is prepared using the above-described device as described below. The drug solution bag is connected to the first connector, the vial is connected to the second connector, and the syringe is connected to the tubular portion. A solvent (e.g., physiological saline solution) is contained in the drug solution bag. A drug in the form of powder is enclosed in the vial. First, a portion of the solvent contained in the drug solution bag is collected into the syringe. Then, the solvent is transferred from the syringe to the vial. The vial is shaken to obtain a drug solution by dissolving the drug in the solvent. Then, the drug solution contained in the vial is collected into the syringe. Finally, the drug solution is injected from the syringe into the drug solution bag. Thus, the prepared drug solution is obtained in the drug solution bag.

PRIOR ART DOCUMENTS

Patent Document

[Patent Document 1] WO 2013/161979
[Patent Document 2] WO 2014/061661
[Patent Document 3] WO 2014/104027
[Patent Document 4] WO 2015/166993

DISCLOSURE OF INVENTION

Problem to be Solved by the Invention

In the drug solution preparation task performed using the above-described device, operations for rotating the stopcock, vertically inverting the device, and inserting and extracting a plunger of the syringe need to be performed in a predetermined order. The device is vertically inverted such that the device and all of the drug solution bag, the vial, and the syringe, which are connected to the device, are inverted around the device to a state in which the drug solution bag is located on the upper side and the vial is located on the lower side or to a state that is the reverse of this. While either state is maintained, the stopcock is rotated and the plunger is inserted and extracted.

As described above, the drug solution preparation task performed using the above-described device is troublesome and poses a large burden on the operator. An apparatus that assists in at least some operations performed by the operator in the preparation task is desired.

In order that the drug solution preparation task can be performed within a limited space in a safety cabinet, it is desirable that the above-described apparatus is compact.

An object of the present invention is to provide a compact apparatus that reduces the burden of the drug solution preparation task on the operator.

Means for Solving Problem

A first drug solution preparation apparatus according to the present invention includes: a device holder configured to hold a transfer device that includes a first connector to which a first container is connectable, a second connector to which a second container is connectable, and a connection port to which a syringe is connectable, the transfer device being switchable between a first state in which the first connector and the connection port are in communication with each other and a second state in which the second connector and the connection port are in communication with each other; a stage on which the device holder is provided; and a second container holder configured to hold the second container coaxially with an axis of the second connector of the transfer device held by the device holder. The stage can be turned to a first turning position where the first connector is located higher than the second connector and a second turning position where the second connector is located higher than the first connector, so as to change an inclination of the stage. The second container holder turns together with the stage about a rotation axis of the stage. The second container holder can be linearly moved along a direction of the axis of the second connector.

A second drug solution preparation apparatus according to the present invention includes: a device holder configured to hold a transfer device that includes a first connector to which a first container is connectable, a second connector to which a second container is connectable, and a connection port to which a syringe is connectable, the transfer device being switchable between a first state in which the first connector and the connection port are in communication with each other and a second state in which the second connector and the connection port are in communication with each other; a stage on which the device holder is provided; and a syringe holder configured to hold the syringe. The stage can be turned to a first turning position where the first connector is located higher than the second connector and a second turning position where the second connector is located higher than the first connector, so as to change an inclination of the stage. The syringe holder holds the syringe such that a longitudinal direction of the syringe is perpendicular to a direction of a rotation axis of the stage.

Effects of the Invention

In the first and second drug solution preparation apparatuses according to the present invention, the device holder that holds the transfer device is provided on the stage, and the stage can be turned to the first turning position and the second turning position. The operator need not continuously hold the transfer device. Therefore, the burden of the drug solution preparation task on the operator is reduced.

In the first drug solution apparatus, the second container holder that holds the second container turns together with the stage and linearly moves along the axis of the second connector. The operator need not attach the second container to the second connector and detach the second container from the second connector, and therefore the burden of the drug solution preparation task on the operator is reduced. The second container can be moved close to the device holder, and therefore the drug solution preparation apparatus is substantially made compact.

The second drug solution preparation apparatus includes the syringe holder that holds the syringe such that the longitudinal direction of the syringe is perpendicular to the direction of the rotation axis of the stage. Accordingly, the length of the entire drug solution preparation apparatus including the syringe along the rotation axis is small.

DESCRIPTION OF THE INVENTION

Figure 1:
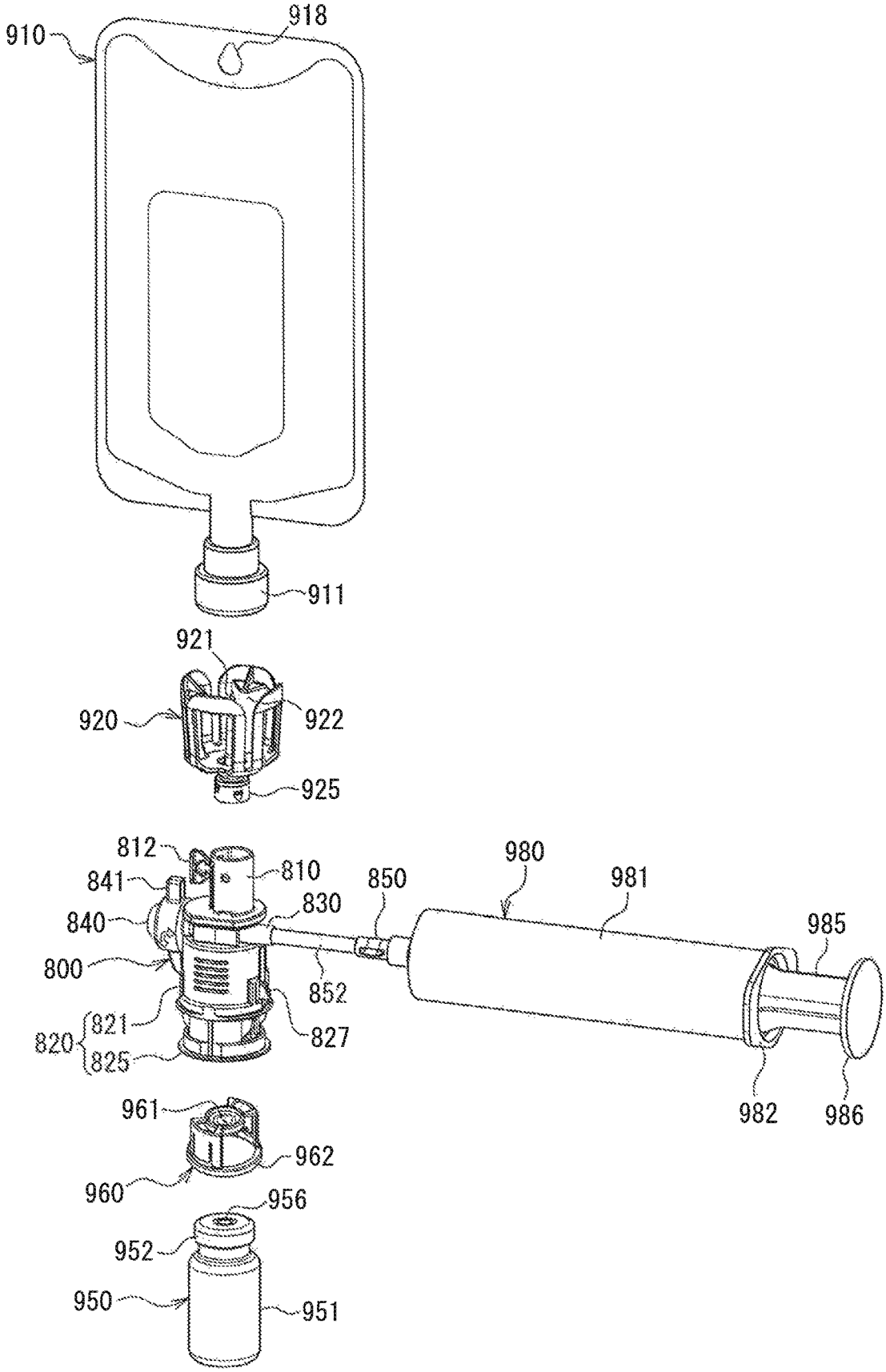
FIG. 1 is an exploded perspective view showing a transfer device, a drug solution bag, a vial, and a syringe that are suitable for a drug solution preparation apparatus according to one embodiment of the present invention.

First and second drug solution preparation apparatuses according to the present invention each include: a device holder configured to hold a transfer device that includes a first connector to which a first container is connectable, a second connector to which a second container is connectable, and a connection port to which a syringe is connectable, the transfer device being switchable between a first state in which the first connector and the connection port are in communication with each other and a second state in which the second connector and the connection port are in communication with each other; and a stage on which the device holder is provided. The stage can be turned to a first turning position where the first connector is located higher than the second connector and a second turning position where the second connector is located higher than the first connector, so as to change an inclination of the stage.

The first drug solution preparation apparatus according to the present invention further includes a second container holder configured to hold the second container coaxially with an axis of the second connector of the transfer device held by the device holder. The second container holder turns together with the stage about a rotation axis of the stage. The second container holder can be linearly moved along a direction of the axis of the second connector.

In the first drug solution preparation apparatus, the second container may be moved along the direction of the axis of the second connector when the stage is located at the second turning position. This aspect makes it possible to adjust the depth of connection between the second connector and the second container, and therefore is advantageous in terms of collecting the entire amount of a drug solution contained in the second container.

The first drug solution preparation apparatus may further include a linear driving mechanism configured to linearly move the second container holder. The linear driving mechanism may be arranged on a side that is opposite to a side of the stage on which the device holder is provided. This aspect is advantageous in terms of making the drug solution preparation apparatus compact by keeping the size of the drug solution preparation apparatus from increasing as a result of providing the linear driving mechanism.

The first drug solution preparation apparatus may further include a syringe holder configured to hold the syringe. The syringe holder may hold the syringe such that a longitudinal direction of the syringe is perpendicular to a direction of the rotation axis of the stage. This aspect is advantageous in terms of reducing the length of the entire drug solution preparation apparatus including the syringe along the rotation axis.

The second drug solution preparation apparatus according to the present invention further includes a syringe holder configured to hold the syringe. The syringe holder holds the syringe such that a longitudinal direction of the syringe is perpendicular to a direction of a rotation axis of the stage.

The second drug solution preparation apparatus may further include a second container holder configured to hold the second container. The second container holder may hold the second container coaxially with an axis of the second connector of the transfer device held by the device holder. The second container holder may linearly move along a direction of the axis of the second connector. This aspect eliminates the need for the second container to be attached to and detached from the second connector by the operator, and therefore is advantageous in terms of reducing the burden of the drug solution preparation task on the operator.

The second container holder may turn together with the stage about a rotation axis of the stage. This aspect is advantageous in terms of making the drug solution preparation apparatus compact. Also, this aspect makes it possible to connect the second container to the second connector and separate the second container from the second connector, irrespective of the turning position of the stage.

In the first and second drug solution preparation apparatuses, the syringe holder may hold the syringe such that the longitudinal direction of the syringe is inclined relative to a direction of an axis of the first connector and a direction of an axis of the second connector. This aspect is advantageous in terms of reducing the length of the drug solution preparation apparatus along the rotation axis.

The drug solution preparation apparatus according to the present invention may be configured such that the syringe holder is capable of holding the syringe in a state in which the syringe is inverted and a leading end of the syringe is oriented downward. This aspect makes it possible to accurately inject a desired amount of a drug solution into a drug solution bag, and therefore is advantageous in terms of suppressing a preparation error of the drug solution.

The drug solution preparation apparatus according to the present invention may be configured such that the syringe holder is capable of holding the syringe in a state in which the syringe is upright and a leading end of the syringe is oriented upward. This aspect makes it possible to accurately measure a solvent contained in the syringe as desired, and therefore is advantageous in terms of suppressing a preparation error of the drug solution.

The syringe holder may turn together with the stage about the rotation axis of the stage. This aspect prevents a channel (e.g., a tube) that connects a tubular portion and the syringe to each other from twisting when the stage is turned. Also, this aspect makes it possible to change the orientation of the syringe to the upright state and/or the inverted state as described above using a mechanism for turning the stage, and therefore is advantageous in terms of simplifying the configuration of the drug solution preparation apparatus.

When the stage is located at the first turning position, the stage may be inclined. This aspect is advantageous in terms of reducing the height and the depth of the drug solution preparation apparatus. Also, this aspect is advantageous in terms of making it easy to perform operations for attaching the device and a drug solution bag to the drug solution preparation apparatus and detaching the device and the drug solution bag from the drug solution preparation apparatus in a state in which the stage is located at the first turning position.

When the stage is located at the second turning position, the second container may be in an inverted state in which a stopper body that seals an opening of the second container is oriented downward, and the first container may be in an upright state in which a port of the first container is oriented upward. Arranging the second container in the inverted state is advantageous in terms of collecting a drug solution from the second container into the syringe. Arranging the first container in the upright state is advantageous in terms of sucking air from the first container.

The first and second drug solution preparation apparatuses may further include a plunger operating portion configured to insert a plunger into an outer cylinder of the syringe and extract the plunger from the outer cylinder of the syringe. This aspect eliminates the need for the plunger to be inserted and extracted by the operator, and therefore is advantageous in terms of reducing the burden of the drug solution preparation task on the operator.

The stage may include a mechanism for holding the first container so as not to separate from the stage when the stage is turned such that the first container connected to the first connector is located below the stage. This aspect eliminates the need for the first container to be held by the operator, and therefore is advantageous in terms of reducing the burden on the operator.

The first and second drug solution preparation apparatuses may further include a rotation driving apparatus configured to turn the stage. This aspect eliminates the need for the stage on which the transfer device is mounted to be turned by the operator, and therefore is advantageous in terms of reducing the burden of the drug solution preparation task on the operator.

The first and second drug solution preparation apparatuses may further include a stopcock operating portion for rotating a stopcock that is provided in the transfer device. The stopcock operating portion may rotate the stopcock such that a channel inside the transfer device is switched between the first state and the second state. This aspect eliminates the need for the stopcock to be rotated by the operator, and therefore is advantageous in terms of reducing the burden of the drug solution preparation task on the operator.

The first container may be an easily deformable container in which a liquid is contained. In this case, the first connector is directly or indirectly connected to a port of the container.

The second container may be a vial in which a drug in the form of powder is enclosed. In this case, the second connector is directly or indirectly connected to an opening of the vial.

The following describes the present invention in detail showing preferred embodiments. However, it goes without saying that the present invention is not limited to the following embodiments. Each drawing referred to below schematically shows an embodiment of the present invention. Accordingly, portions shown in the drawings referred to below may be changed or omitted, or any member of configuration may be added, within the scope of the present invention. In the drawings referred to in the description of embodiments, the same or corresponding members are denoted using the same reference numeral.

1. Transfer Device

FIG. 1 is an exploded perspective view showing a transfer device (hereinafter simply referred to as "device") 800, a drug solution bag (first container) 910, a vial (second container) 950, and a syringe 980 that are suitable for a drug solution preparation apparatus 1 (see FIG. 2 described below) according to one embodiment of the present invention.

The device 800 includes a first connector 810 to which the drug solution bag 910 is to be connected, a second connector 820 to which the vial 950 is to be connected, and a connection port 850 to which the syringe 980 is to be connected. The first connector 810 and the second connector 820 are arranged such that their axes (not shown) are parallel to each other (i.e., in the up-down direction in FIG. 1) and are open toward mutually opposite sides. A tubular portion 830 that has a hollow substantially cylindrical shape and is open at both ends is provided between the first connector 810 and the second connector 820. The tubular portion 830 extends substantially perpendicularly to the axes of the first connector 810 and the second connector 820. A stopcock 840 is inserted into one end of the tubular portion 830. The connection port 850 is connected to the other end of the tubular portion 830 via a soft tube 852. The connection port 850 has a hollow substantially cylindrical shape.

The drug solution bag 910 is not limited, but is ordinarily an easily deformable liquid-tight container. The drug solution bag 910 in the present embodiment is a bag-shaped member that is obtained by overlaying two soft substantially rectangular sheets on each other and sealing outer peripheral edge portions thereof using a welding method (e.g., heat sealing method or ultrasonic welding method), for example. However, the drug solution bag in the present invention is not limited thereto, and may be a container that is manufactured using a blow molding method or the like, for example. The shape of the drug solution bag 910 freely changes as a result of the content of the drug solution bag 910 moving under gravity or an external force being applied to the drug solution bag 910, for example. A solvent (e.g., physiological saline solution) for dissolving a drug contained in the vial 950 is contained in the drug solution bag 910 in an initial state. The drug solution bag 910 includes a port 911 through which a liquid is introduced into or discharged from the drug solution bag 910. The opening of the port 911 is sealed using a stopper body (e.g., a rubber stopper, not shown). A hole 918 is provided in an end of the drug solution bag 910 on the side opposite to the port 911. The hole 918 is used to suspend the drug solution bag 910 in a state in which the port 911 is located on the lower side when a drug solution contained in the drug solution bag 910 is administered to a patient.

The port 911 of the drug solution bag 910 is connected to the first connector 810 via an adapter 920. Although the adapter 920 may have any configuration, the adapter 920 in the present embodiment is substantially the same as that described in Patent Document 2. The adapter 920 includes a plurality of engagement claws 922 and a puncture needle 921 that includes a sharp leading end, on the drug solution bag 910 side, and a mixed injection port 925 that includes an elastic partition member called a septum, on the first connector 810 side. The puncture needle 921 and the mixed injection port 925 are in communication with each other. The adapter 920 is connected to the port 911 in a state in which the puncture needle 921 is stuck into the stopper body of the port 911 of the drug solution bag 910 and the engagement claws 922 are engaged with the port 911. The adapter 920 cannot be separated from the port 911 unless the engagement claws 922 are disengaged from the port 911.

The first connector 810 is a lever lock connector (see Patent Document 1, for example) that includes a rod-shaped first male member (not shown) and a lock lever 812 that is provided with a claw (not shown) that protrudes toward the first male member. A hollow substantially cylindrical hood surrounds the first male member. The first male member defines the axis of the first connector 810. Inside the first male member, a channel is provided extending along the longitudinal direction of the first male member. The channel is in communication with the tubular portion 830. The first male member is inserted into the elastic partition member of the mixed injection port 925 of the adapter 920 and the claw of the lock lever 812 is engaged with the mixed injection port 925 of the adapter 920. The adapter 920 cannot be separated from the first connector 810 unless the claw of the lock lever 812 is disengaged from the mixed injection port 925. The drug solution bag 910 is brought into communication with the tubular portion 830 via the adapter 920 and the first male member of the first connector 810.

Although the drug solution bag 910 is connected to the first connector 810 via the adapter 920 in the present embodiment, the present invention is not limited to this configuration, and a configuration is also possible in which the drug solution bag 910 is directly connected to the first connector 810 not via the adapter 920, for example.

The vial 950 includes a bottle main body 951 and a stopper body (rubber stopper) 956. The bottle main body 951 is made of a hard material that does not substantially deform, such as glass. The bottle main body 951 is a hollow cylindrical container that includes an opening on the upper side. A liquid is introduced into or discharged from the vial 950 through the opening. The bottle main body 951 is provided with a flange 952 that surrounds the opening and protrudes in a radial direction. As a result of the stopper body 956 being fitted into the opening of the bottle main body 951, the opening is sealed in an air-tight and liquid-tight manner. A drug in the form of powder (not shown) is contained in the vial 950 in an initial state.

A vial shield 960 is attached to the vial 950 to cover the stopper body 956. Although the vial shield 960 may have any configuration, the vial shield 960 in the present embodiment is substantially the same as that described in Patent Document 3. The vial shield 960 includes a circular thin plate-shaped valve body 961 that is made of an elastic material, such as rubber, and a main body 962 that holds the valve body 961. The main body 962 is provided with a plurality of claws. The vial shield 960 is attached to the vial 950 in a state in which the valve body 961 is overlaid on the upper surface of the stopper body 956 and the claws are engaged with the flange 952 of the bottle main body 951. The vial shield 960 cannot be separated from the vial 950 unless the claws are disengaged from the flange 952. When the vial shield 960 is attached to the vial 950, a portion of the flange 952 of the bottle main body 951 is exposed to the outside.

The vial 950 is connected to the second connector 820 in a state in which the vial shield 960 is attached to the vial 950. Although the second connector 820 may have any configuration, the second connector 820 in the present embodiment is substantially the same as that described in Patent Document 4. The second connector 820 includes a substantially cylindrical slider 825 and a substantially cylindrical connector main body 821 that is formed so as to constitute a single piece together with the tubular body 830. The slider 825 is coaxially inserted into the connector main body 821 and is movable in the axial direction relative to the connector main body 821. The connector main body 821 includes a rod-shaped second male member (not shown) that is coaxial with the connector main body 821. The connector main body 821 surrounds the second male member. The second male member defines the axis of the second connector 820. The second male member is a puncture needle that includes a sharp leading end. Inside the second male member, a liquid channel and a gas channel are provided independently of each other extending along the longitudinal direction of the second male member (see FIG. 9C described later). The slider 825 is provided with a plurality of claws (not shown) that protrude toward the second male member.

When the second connector 820 is connected to the vial 950, the second male member penetrates the valve body 961 of the vial shield 960 and the stopper body 956 of the vial 950 in this order. The vial 950 is brought into communication with the tubular portion 830 via the liquid channel and the gas channel of the second male member. The flange 952 of the vial 950 is inserted into the slider 825 and the claws of the slider 825 engage with the flange 952. The slider 825 is inserted into the connector main body 821 together with the vial 950.

The vial 950 cannot be separated from the second connector 820 unless the claws of the slider 825 are disengaged from the flange 952 of the vial 950. The second connector 820 is configured such that, if the vial 950 is strongly pulled away from the second connector 820 in a state in which the vial 950 and the slider 825 are located at a maximum extraction position as a result of having been extracted from the connector main body 821 by a maximum length, the claws are disengaged from the flange 952 and the vial 950 can be separated from the second connector 820. A release button 827 is provided on the second connector 820. Unless the release button 827 is in a state of being pressed in a radially inward direction, the vial 950 and the slider 825 cannot be extracted from the connector main body 821 to the maximum extraction position, and accordingly the vial 950 cannot be separated from the second connector 820.

In the present embodiment, the vial 950 is connected to the second connector 820 in a state in which the vial shield 960 is attached to the vial 950, but the present invention is not limited to this configuration, and a configuration is also possible in which the vial 950 is connected to the second connector 820 with the vial shield 960 not being attached to the vial 950, for example. The second connector 820 may have a configuration in which the release button 827 is omitted and the vial 950 and the slider 825 can be extracted from the connector main body 821 to the maximum extraction position without pressing the release button 827. The second connector 820 may also have a configuration from which the slider 825 is omitted and that is similar to the configuration of a second connector described in Patent Document 1.

The stopcock 840 includes a columnar insertion portion (not shown) that is inserted into the tubular portion 830 and an operation lever 841 that is exposed to the outside. The insertion portion and the operation lever 841 are linked to each other at a right angle to form a substantially "T" shape. A plurality of channels (not shown) are provided inside the insertion portion. As a result of the stopcock 840 being rotated relative to the tubular portion 830, the plurality of channels provided inside the insertion portion are rotated. When the stopcock 840 is located at a first rotation position (a first state), the channel inside the first male member of the first connector 810 is in communication with the connection port 850. When the stopcock 840 is located at a second rotation position (a second state), the liquid channel inside the second male connector of the second connector 820 is in communication with the connection port 850. As described above, by rotating (in the present embodiment, rotating by 180 degrees) the stopcock 840, the channels within the device 800 can be switched between the first state in which the drug solution bag 910 is in communication with the syringe 980 and the second state in which the vial 950 is in communication with the syringe 980. Note that, in the first state (first rotation position), the liquid channel and the gas channel inside the second male member of the second connector 820 are sealed by the stopcock 840. In the second state (second rotation position), the gas channel inside the second male member of the second connector 820 is in communication with the channel inside the first male member of the first connector 810.

Similarly to an ordinary syringe, the syringe 980 includes a hollow cylindrical outer cylinder (also called "barrel") 981 and a plunger (also called "pusher") 985 that can be inserted into and extracted from the outer cylinder 981. The leading end of the outer cylinder 981 is connected to the connection port 850 (in FIG. 1, the leading end is inserted into the connection port 850 and cannot be seen). A finger flange 982 that protrudes outward and to which a finger can be hooked is provided at a rear end of the outer cylinder 981. A substantially circular pressing plate 986 is provided at a rear end of the plunger 985.

A method for preparing a drug solution using the device 800 is substantially the same as that described in Patent Document 1. A drug solution can be prepared using the device 800 in the same manner as that described in Patent Document 1, without using the drug solution preparation apparatus of the present invention.

2. Configuration of Drug Solution Preparation Apparatus

Figure 2:
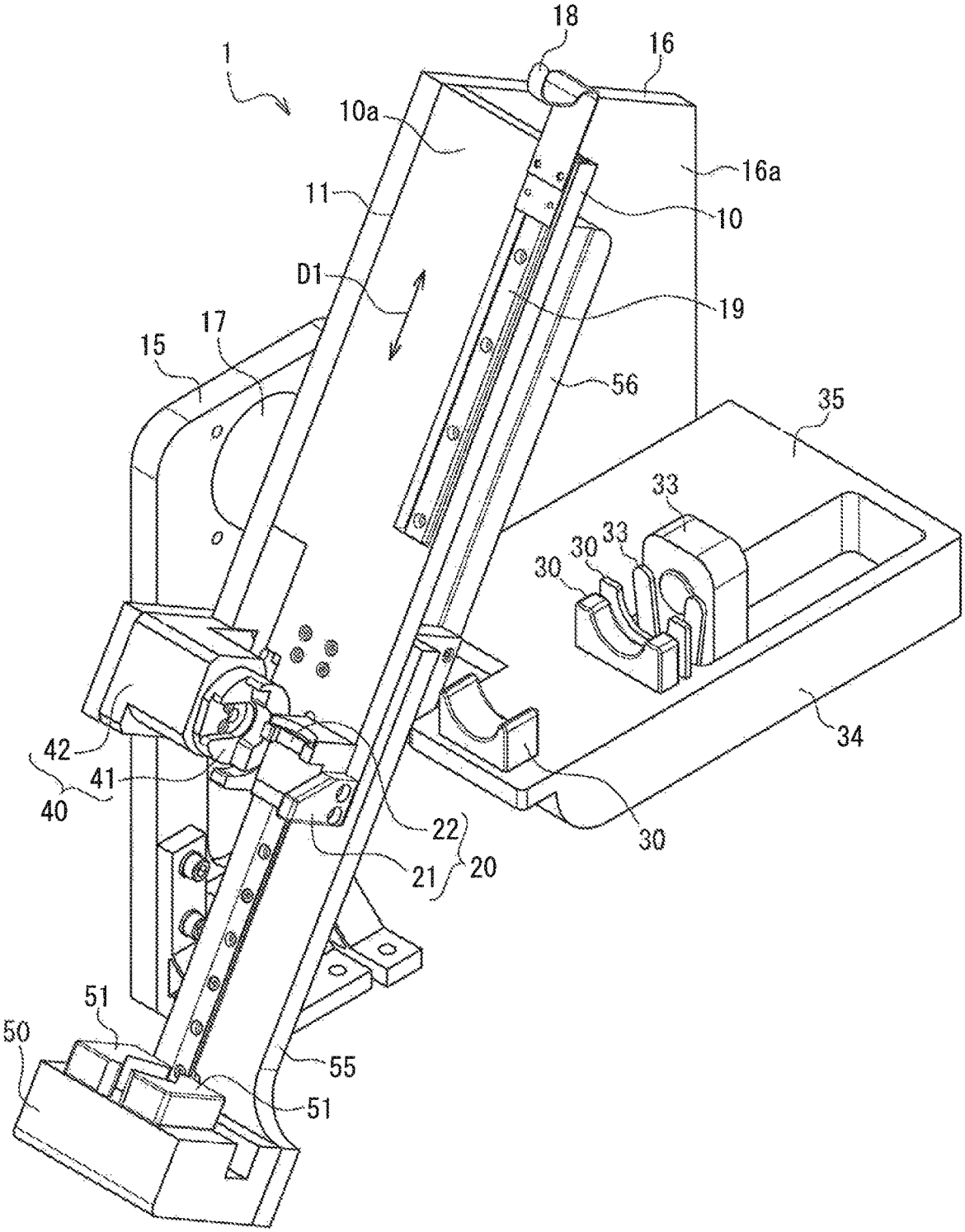
FIG. 2 is a perspective view showing the drug solution preparation apparatus according to one embodiment of the present invention.

FIG. 2 is a perspective view showing the drug solution preparation apparatus (hereinafter referred to as a "preparation apparatus") 1 according to one embodiment of the present invention. The preparation apparatus 1 includes a stage (main stage) 10, a device holder 20, a syringe holder 30, and a vial holder 50.

A support 15 that extends along the vertical direction is provided on the upper surface of a base plate (not shown) that serves as the base of the preparation apparatus 1. A rotary side plate 16 is connected to the support 15 in a rotatable manner. A rotation driving apparatus 17 that is interposed between the support 15 and the rotary side plate 16 rotates the rotary side plate 16. The rotation axis of the rotary side plate 16 (hereinafter simply referred to as the "rotation axis") is parallel to the horizontal direction. The rotary side plate 16 is a plate-shaped member that includes a flat main surface (the surface having the largest area) 16*a* on the side opposite to the support 15. The main surface 16*a* is perpendicular to the rotation axis. The stage 10 is provided on the main surface 16*a* of the rotary side plate 16. The stage 10 is a substantially rectangular thin plate-shaped member that includes a flat placement surface 10*a*. The placement surface 10*a* is perpendicular to the main surface 16*a* of the rotary side plate 16 and parallel to the rotation axis. A side 11 of the stage 10 is fixed to the main surface 16*a* of the rotary side plate 16. For the sake of convenience of the following description, a direction that is parallel to the side 11 will be referred to as a "first direction D1" of the stage 10. The first direction D1 is parallel to the placement surface 10*a* and perpendicular to the rotation axis.

On the placement surface 10*a* of the stage 10, the device holder 20 is provided on one side in the first direction D1 and a hook 18 is provided on the other side in the first direction D1.

The device holder 20 includes a first holding portion 21, the entirety of which has a substantially "U" shape, and a second holding portion 22 that extends straight in parallel to the rotation axis of the rotary side plate 16. The first holding portion 21 includes a pair of holding pieces that extend perpendicularly to the placement surface 10*a*. The pair of holding pieces face each other in the direction of the rotation axis. The first holding portion 21 holds the device 800 by pinching the connector main body 821 (see FIG. 1).

The hook 18 is curved and has a hook shape so that the hook can be inserted into the hole 918 (see FIG. 1) of the drug solution bag 910 and engage with the drug solution bag 910. The hook 18 can be moved along the first direction D1 using a linear guide mechanism 19 and can be fixed at a desired position in the first direction D1 relative to the stage 10. The position of the hook 18 is appropriately adjusted according to the size of the drug solution bag 910 (in particular, the distance between the port 911 and the hole 918).

A syringe stage 35 is also provided on the main surface 16*a* of the rotary side plate 16. The syringe stage 35 is inclined relative to the placement surface 10*a* of the stage 10. The syringe holder 30 is provided on the syringe stage 35. The syringe holder 30 includes a plurality of semi-cylindrical placement surfaces that conform to the outer circumferential surface of the outer cylinder 981. The syringe holder 30 includes a slot-shaped groove that is adjacent to the placement surfaces so that the finger flange 982 (see FIG. 1) protruding from the outer cylinder 981 can fit in the groove.

A plunger operating portion 33 is also provided on the syringe stage 35. The plunger operating portion 33 includes a slot-shaped groove so that the pressing plate 986 (see FIG. 1) of the plunger 985 can fit in the groove. The plunger operating portion 33 can linearly reciprocate so that the plunger 985 can be inserted into and extracted from the outer cylinder 981. The plunger operating portion 33 is moved using a plunger driving mechanism 34. Although the plunger driving mechanism 34 may have any configuration, for example, a desired single axis actuator, such as a cylinder apparatus or a feed screw, can be used as the plunger driving mechanism 34. The plunger driving mechanism 34 is provided in the syringe stage 35.

A stopcock operating portion 40 is provided in the vicinity of the device holder 20 so as to be adjacent to the device holder 20 in the horizontal direction. The stopcock operating portion 40 includes a rotor 41 and a driving mechanism 42 that rotates the rotor 41. The rotor 41 has a shape that fits to the operation lever 841 (see FIG. 1) of the stopcock 840 of the device 800. In a state in which the operation lever 841 is fitted to the rotor 41, the operation lever 841 rotates together with the rotor 41. The rotation axis of the rotor 41 is parallel to the rotation axis of the rotary side plate 16. Although the stopcock operating portion 40 is provided on the rotary side plate 16 in the present embodiment, the present invention is not limited to this configuration, and the stopcock operating portion 40 may be provided on the stage 10, for example.

The vial holder 50 includes a pair of chucks 51 that securely hold the bottle main body 951 (see FIG. 1) of the vial 950 in the diametrical direction of the bottle main body 951. Each of the pair of chucks 51 can be moved to increase or reduce the distance therebetween. The vial holder 50 holds the vial 950 such that the central axis of the vial 950 is parallel to the first direction D1. The vial holder 50 is provided on a plate-shaped movable piece 55. The movable piece 55 is linked to the stage 10 so as to be linearly movable along the first direction D1 (i.e., the central axis of the vial 950). A linear driving mechanism 56 moves the movable piece 55 along the first direction D1 together with the vial holder 50. Although the linear driving mechanism 56 may have any configuration, for example, a desired single axis actuator, such as a cylinder apparatus or a feed screw, can be used as the linear driving mechanism 56. The linear driving mechanism 56 is arranged on the side opposite to the placement surface 10*a* of the stage 10. A fixed portion of the linear driving mechanism 56 is fixed to the rotary side plate 16 (or the stage 10) and a movable portion of the linear driving mechanism 56 is connected to the movable piece 55, although this is not shown. Movement of the vial holder 50 in the direction toward the device holder 20 will be referred to as "forward movement" and movement of the vial holder 50 in the direction away from the device holder 20 will be referred to as "backward movement".

The rotary side plate 16 rotates about the rotation axis that is parallel to the horizontal direction. When the rotary side plate 16 rotates, the stage 10, the device holder 20, the syringe holder 30, the plunger operating portion 33, the stopcock operating portion 40, and the vial holder 50, which are provided directly or indirectly on the rotary side plate 16, also rotate about the common rotation axis together with the rotary side plate 16. The rotation axis of the rotary side plate 16 also serves as the rotation axis of the stage 10.

Although a detailed description will be given later, the stage 10 can be positioned at four typical turning positions as a result of the rotary side plate 16 rotating. That is, the stage 10 can be turned to a first turning position shown in FIGS. 2 to 4 and 6 to 8, a second turning position shown in FIGS. 9A to 9C and 11, a third turning position shown in FIGS. 5A and 5B, and a fourth turning position shown in FIG. 10, so as to change the inclination of the stage 10.

The rotation driving apparatus 17 of the rotary side plate 16, the plunger driving mechanism 34 of the plunger operating portion 33, the driving mechanism 42 of the stopcock operating portion 40, the vial holder 50, and the linear driving mechanism 56 of the vial holder 50 are controlled by a controller (not shown). The preparation apparatus 1 may further include a transfer apparatus (e.g., a robot) for moving the vial 950 to a desired position including the vial holder 50, or a camera for performing image recognition of the vial 950 and/or the syringe 980. The controller may control operations of each portion of the preparation apparatus 1 based on information obtained from the camera.

3. Drug Solution Preparation Method using Drug Solution Preparation Apparatus

The following describes a method for preparing a drug solution using the preparation apparatus 1.

First, the device 800, the drug solution bag 910, the adapter 920, the vial 950, and the vial shield 960 are prepared as shown in FIG. 1. The syringe 980 is connected to the connection port 850 of the device 800. The plunger 985 is inserted to the innermost end of the outer cylinder 981. The stopcock 840 of the device 800 is located at the second rotation position (second state) and the connection port 850 is in communication with the second connector 820. A solvent (e.g., physiological saline solution) is contained in the drug solution bag 910. The drug solution bag 910 may further contain a small amount of air. The adapter 920 is connected to the port 911 of the drug solution bag 910, and also connected to the first connector 810 of the device 800. A drug (e.g., anticancer drug) in the form of powder is contained in the vial 950. The vial shield 960 is attached to the vial 950.

Also, the preparation apparatus 1 shown in FIG. 2 is prepared. The preparation apparatus 1 is installed in a safety cabinet that is ordinarily used when preparing a drug solution containing an anticancer drug. If the preparation apparatus 1 is housed in the safety cabinet, the possibility of the drug leaking to the outside decreases, and this is advantageous when preparing a drug solution using a dangerous drug, such as an anticancer drug, in terms of preventing the operator from being exposed to the drug. The stage 10 is located at the first turning position. The stage 10 located at the first turning position is inclined relative to the horizontal direction. More specifically, the first direction D1 of the stage 10 is inclined relative to the horizontal direction (i.e., is not parallel or perpendicular to the horizontal direction) such that the hook 18 is located higher than the device holder 20. The vial holder 50 is located at the farthest position from the device holder 20.

Figure 3:
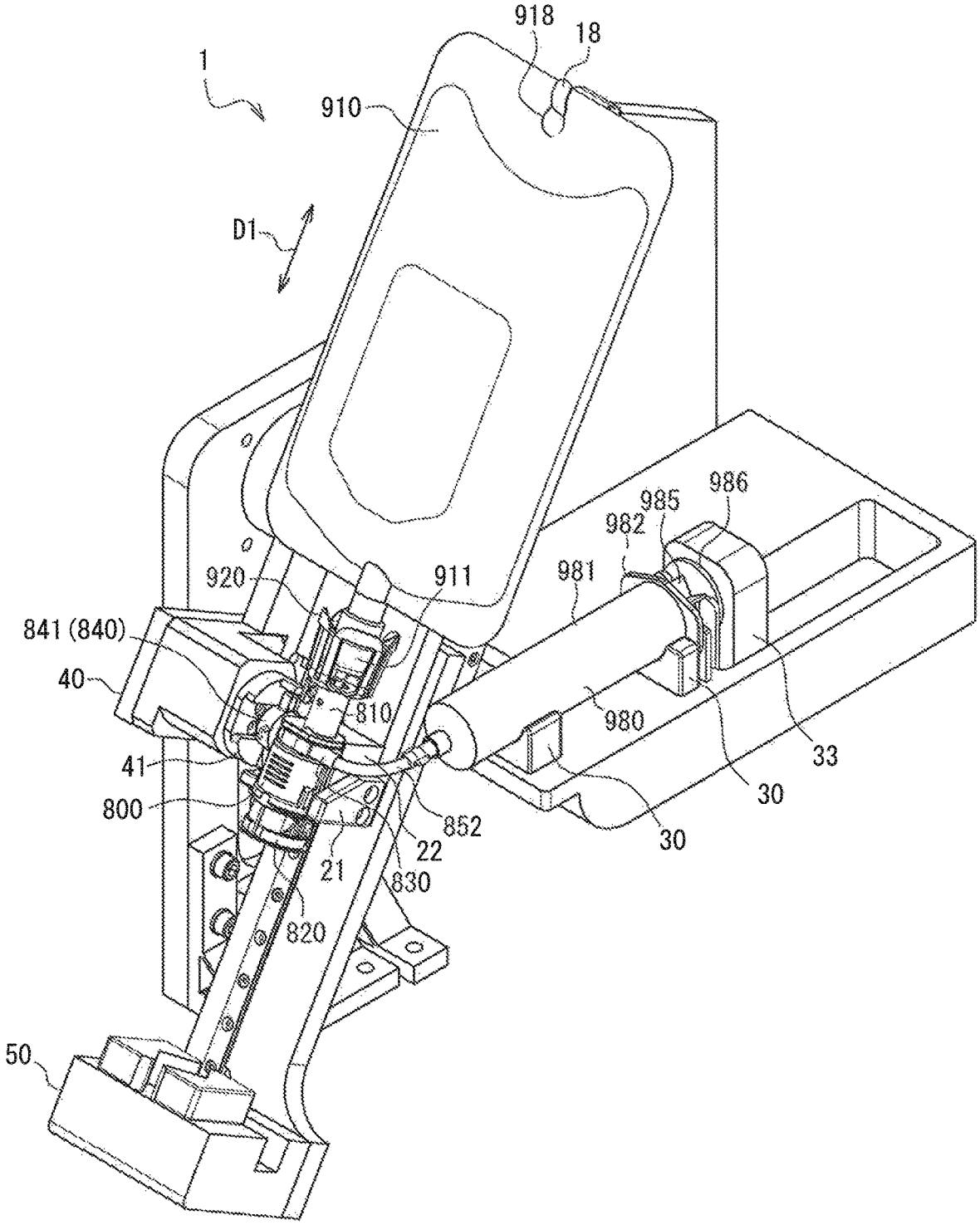
FIG. 3 is a perspective view showing a state just before preparation of a drug solution is started using the drug solution preparation apparatus according to one embodiment of the present invention.

Next, as shown in FIG. 3, the device 800 is held by the device holder 20 and the drug solution bag 910 is placed on the stage 10.

The second connector 820 (specifically, the connector main body 821, see FIG. 1) of the device 800 is fitted into the substantially "U" shaped first holding portion 21 of the device holder 20. The release button 827 (see FIG. 1) of the second connector 820 enters the state of being pressed by the first holding portion 21. The tubular portion 830 of the device 800 is placed on the second holding portion 22 of the device holder 20 in parallel to the rotation axis of the stage 10. The axes of the first connector 810 and the second connector 820 are parallel to the first direction D1. When the device 800 is held by the device holder 20, the device 800 cannot move in the first direction D1. The first connector 810 is located higher than the second connector 820 because the stage 10 is located at the first turning position.

The operation lever 841 (see FIG. 1) of the stopcock 840 engages with the rotor 41 of the stopcock operating portion 40.

The drug solution bag 910 is placed on the placement surface 10*a* (see FIG. 2) of the stage 10. As a result of the hook 18 being inserted into the hole 918 of the drug solution bag 910, the drug solution bag 910 is locked on the hook 18. The hook 18 is fixed to the stage 10 in a state of being positioned in the first direction D1 so as to slightly pull on the drug solution bag 910 in the first direction D1. The port 911 of the drug solution bag 910 is oriented diagonally downward.

As described above, the drug solution bag 910 is an easily deformable bag-shaped container and contains a solvent. The drug solution bag 910 can be easily placed on the stage 10 because the placement surface 10*a* of the stage 10 faces diagonally upward. After the drug solution bag 910 is placed on the stage 10, the stage 10 supports the drug solution bag 910, and accordingly the shape of the drug solution bag 910 is stably maintained.

The outer cylinder 981 of the syringe 980 is placed and held on the semi-cylindrical placement surfaces of the syringe holder 30. The finger flange 982 (see FIG. 1) of the outer cylinder 981 fits in the slot-shaped groove provided in the syringe holder 30. Accordingly, the outer cylinder 981 cannot move in the longitudinal direction of the outer cylinder 981 (i.e., the insertion/extraction direction of the plunger 985). The pressing plate 986 of the plunger 985 is fitted in the slot-shaped groove in the plunger operating portion 33. The position of the plunger 985 in the insertion/extraction direction relative to the outer cylinder 981 is defined by the plunger operating portion 33. The longitudinal direction of the syringe 980 (or the outer cylinder 981) is perpendicular to the rotation axis of the stage 10 (or the rotary side plate 16). Also, the longitudinal direction of the syringe 980 is inclined forming an acute angle with respect to the first direction D1 of the stage 10. The tube 852 connecting the tubular portion 830 and the outer cylinder 981 to each other is curved substantially at a right angle. In the present embodiment, when the stage 10 is located at the first turning position, the longitudinal direction of the syringe 980 is parallel to the horizontal direction. However, the present invention is not limited to this configuration, and the longitudinal direction of the syringe 980 may be inclined relative to the horizontal direction when the stage 10 is located at the first turning position.

The above-described operations are manually performed by the operator.

Figure 4:
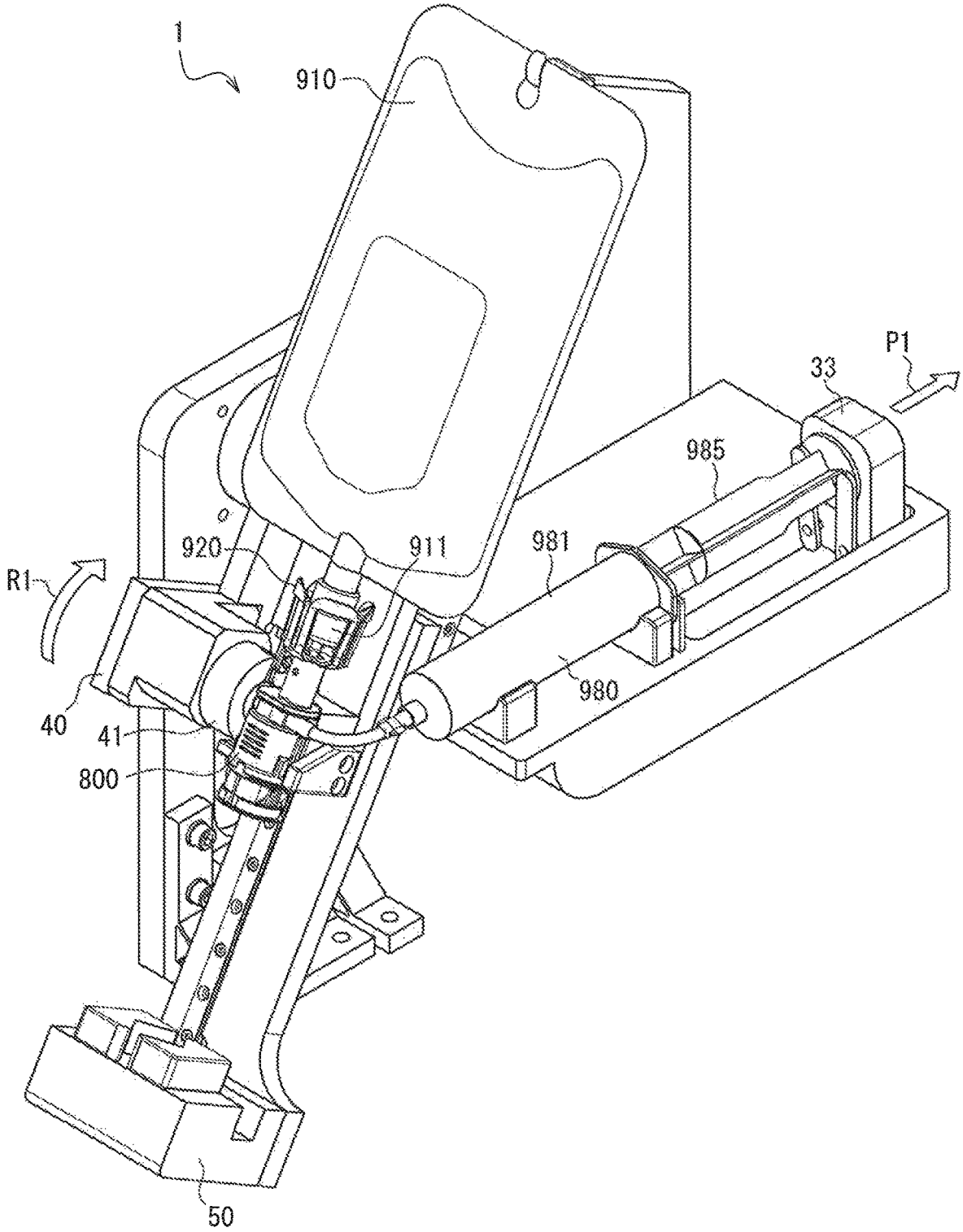
FIG. 4 is a perspective view showing a state in which a portion of a solvent contained in the drug solution bag is collected into the syringe in drug solution preparation performed using the drug solution preparation apparatus according to one embodiment of the present invention.

Next, as shown in FIG. 4, the rotor 41 of the stopcock operating portion 40 rotates in the direction of an arrow R1 to rotate the stopcock 840 to the first rotation position. Thus, the device 800 transitions to the first state in which the drug solution bag 910 is in communication with the syringe 980.

Next, the plunger operating portion 33 moves in the direction of an arrow P1 to extract the plunger 985 from the outer cylinder 981. A portion of the solvent contained in the drug solution bag 910 is collected into the syringe 980 via the adapter 920 and the device 800. Even if air is contained in the drug solution bag 910, the air does not flow out from the drug solution bag 910.

Before the plunger 985 is extracted in the direction of the arrow P1 in the state shown in FIG. 4, air exists in the channel from the port 911 of the drug solution bag 910 to the syringe 980 (i.e., the channel inside the adapter 920 and the device 800 (specifically, the first connector 810, the tubular portion 830, the tube 852, and the connection port 850)). Accordingly, in some cases, as a result of the plunger 985 being extracted in the direction of the arrow P1, first, air inside the channel flows into the syringe 980 and then the solvent flows into the syringe 980. Therefore, the following operation may be performed as desired to discharge air that has flown into the syringe 980.

Figure 5A:
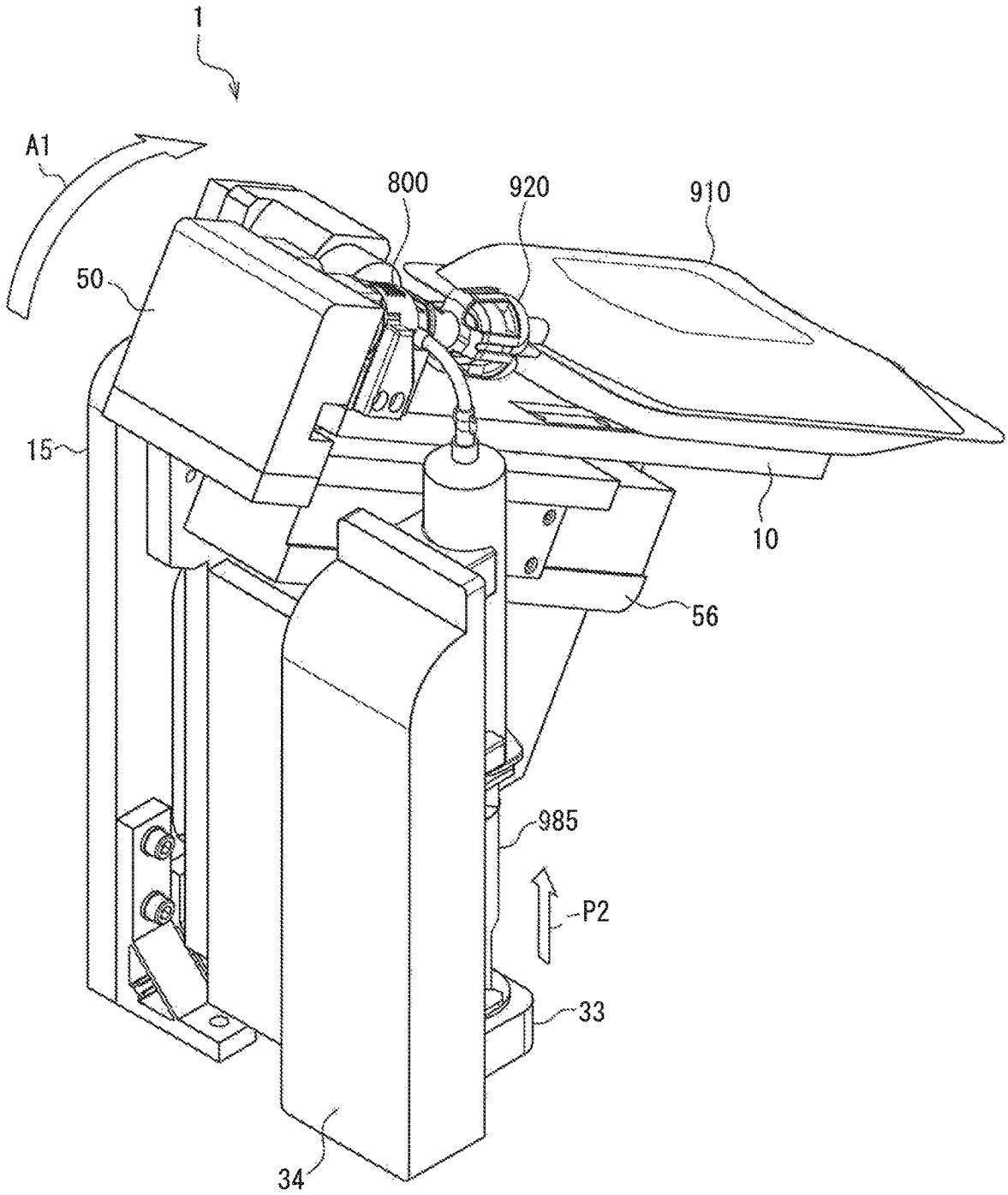
FIG. 5A is a perspective view showing a step in which a stage is turned to a third turning position and air inside the syringe is discharged in drug solution preparation performed using the drug solution preparation apparatus according to one embodiment of the present invention.
Figure 5B:
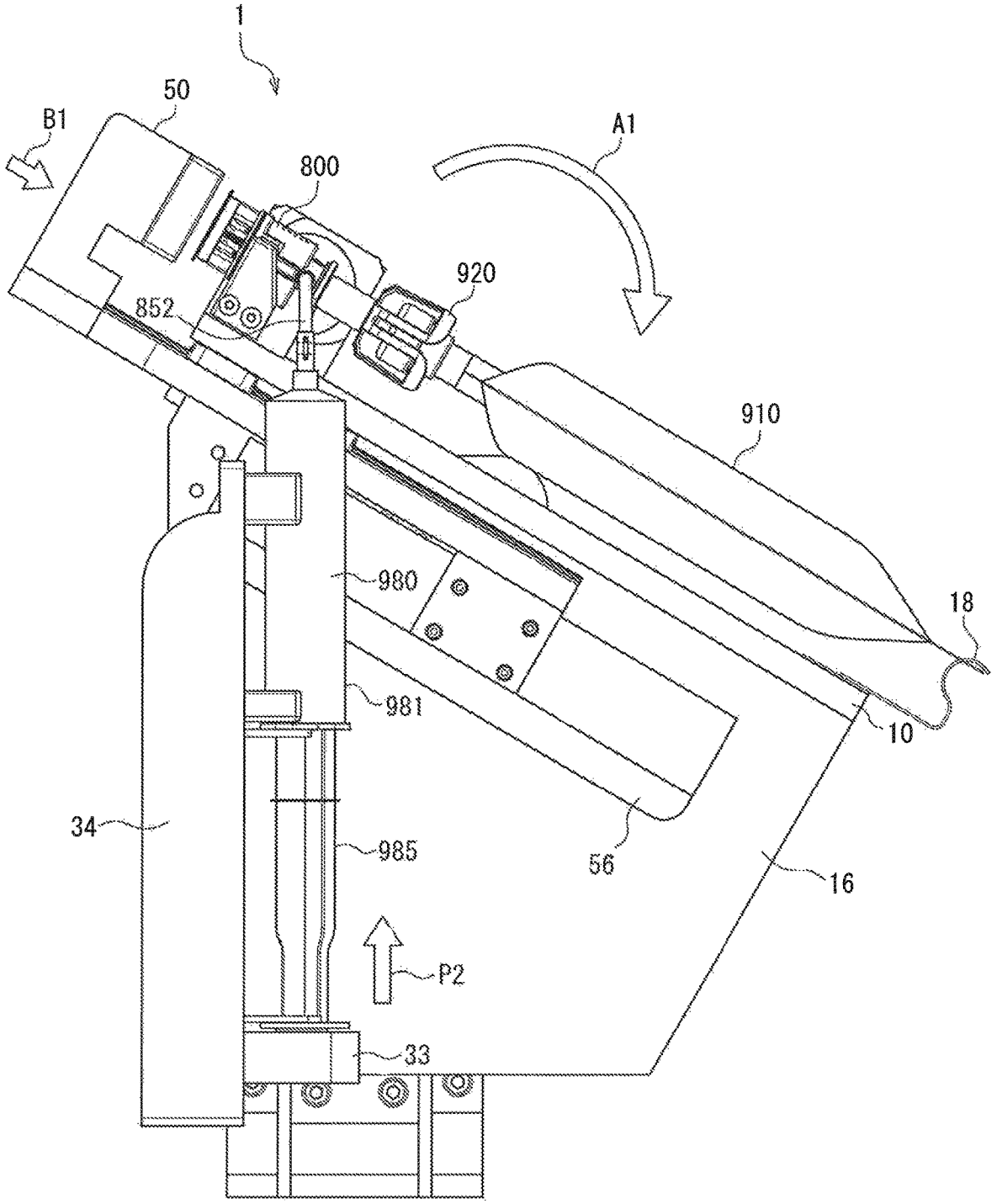
FIG. 5B is a side view of FIG. 5A.

That is, as shown in FIGS. 5A and 5B, the stage 10 is turned in the direction of an arrow A1 to the third turning position.

Note that, in the present embodiment, as most clearly shown in FIG. 5B, the vial holder 50 is moved forward in the direction of an arrow B1 before the stage 10 is turned in the direction of the arrow A1. This is for reducing the turning radius to enable turning within a limited space inside the safety cabinet. If the stage 10 can be turned without the vial holder 50 colliding with surrounding members, the vial holder 50 need not be moved forward.

When the stage 10 is located at the third turning position, the syringe 980 is upright with the leading end of the syringe 980 being oriented upward. The longitudinal direction of the syringe 980 is parallel to the vertical direction. Air inside the syringe 980 gathers at the vicinity of the leading end. In this state, the plunger operating portion 33 moves in the direction of an arrow P2 to insert the plunger 985 into the outer cylinder 981. The air inside the syringe 980 flows from the syringe 980 through the device 800 (specifically, the connection port 850, the tube 852, the tubular portion 830, and the first connector 810) and the adapter 920 toward the drug solution bag 910. All of the air inside the syringe 980 is discharged from the syringe 980. As a result, the solvent contained in the syringe 980 can be accurately measured.

Figure 6:
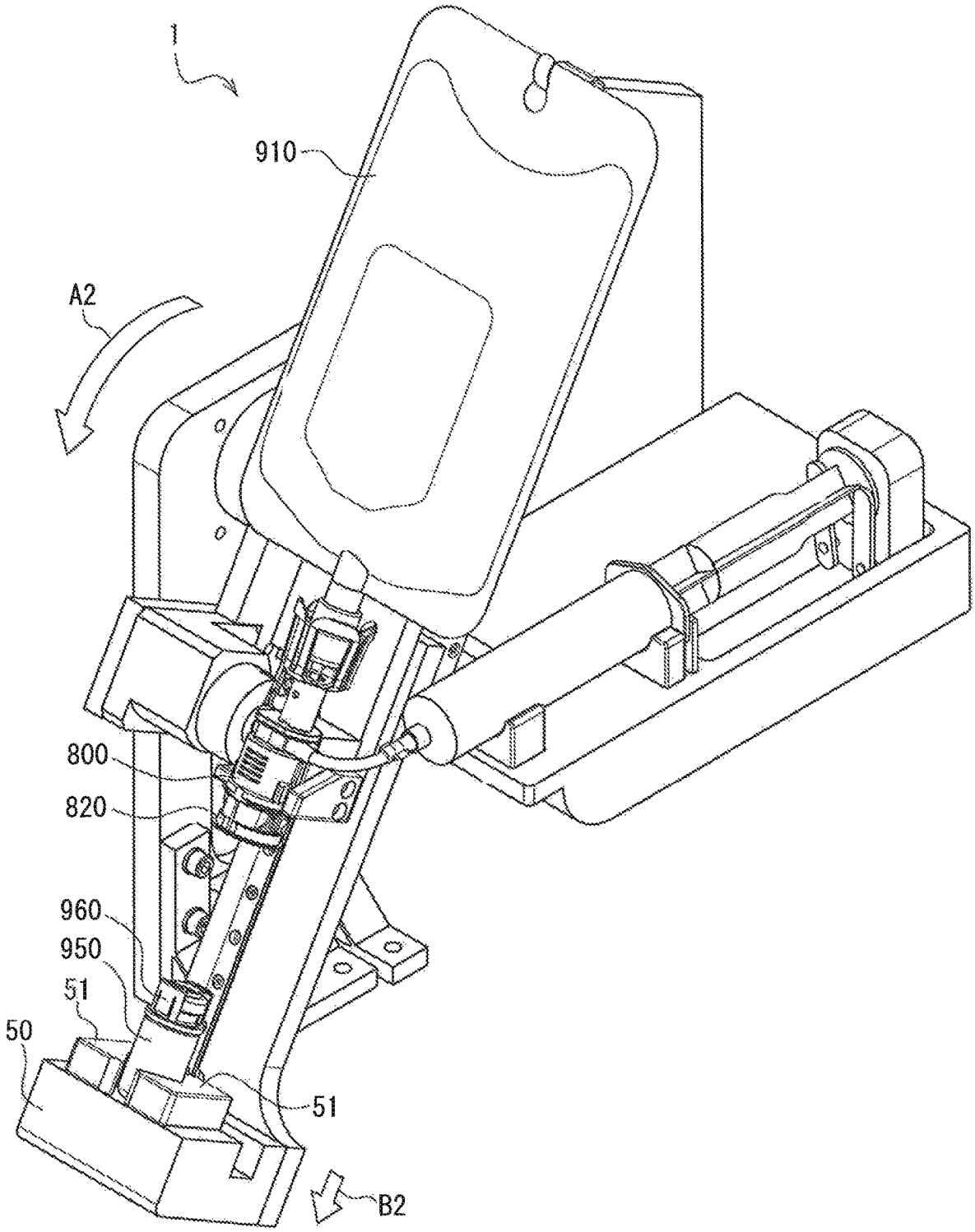
FIG. 6 is a perspective view showing a state in which the vial is held by a vial holder in drug solution preparation performed using the drug solution preparation apparatus according to one embodiment of the present invention.

Next, as shown in FIG. 6, the stage 10 is turned in the direction of an arrow A2 to return to the first turning position (see FIGS. 2 to 4). Subsequently, the vial holder 50 is moved backward in the direction of an arrow B2. Then, the vial (first vial) 950 is placed on the vial holder 50. The vial 950 may be placed on the vial holder 50 by the operator or using a transfer device (e.g., a robot, not shown). The chucks 51 securely hold the vial 950 (a held state). The vial holder 50 holds the vial 950 coaxially with the second connector 820.

Figure 7:
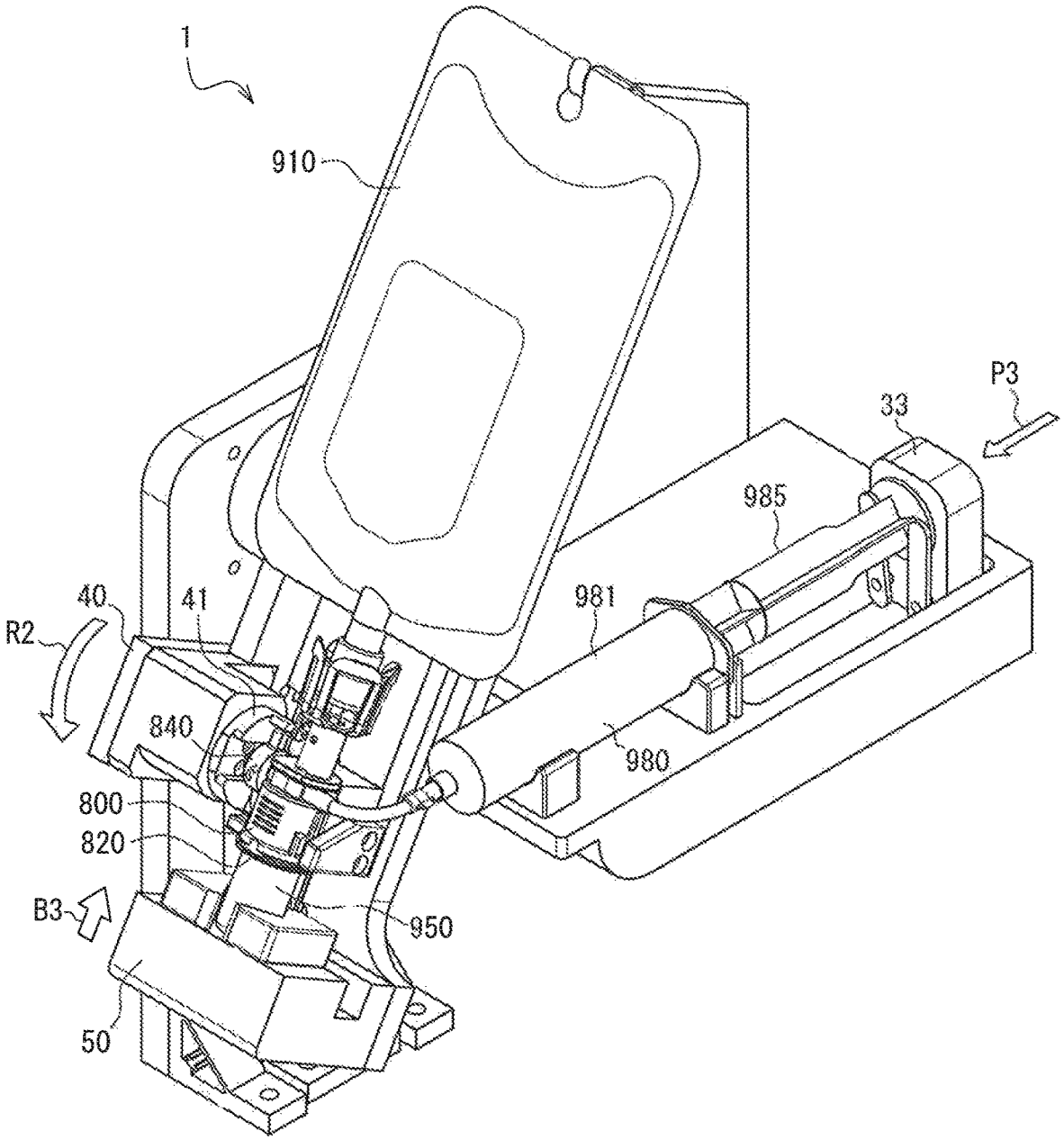
FIG. 7 is a perspective view showing a state in which the vial is connected to a second connector in drug solution preparation performed using the drug solution preparation apparatus according to one embodiment of the present invention.

Next, as shown in FIG. 7, the vial holder 50 moves forward in the direction of an arrow B3 to press the vial 950 into the second connector 820. The second male member of the second connector 820 penetrates the valve body 961 (see FIG. 1) of the vial shield 960 and sticks into the stopper body 956 (see FIG. 1) of the vial 950. The vial 950 is connected to the second connector 820.

Then, the rotor 41 of the stopcock operating portion 40 rotates in the direction of an arrow R2 to rotate the stopcock 840 to the second rotation position. Thus, the device 800 transitions to the second state in which the vial 950 is in communication with the syringe 980.

Next, the plunger operating portion 33 moves in the direction of an arrow P3 to press the plunger 985 into the outer cylinder 981. The solvent contained in the syringe 980 is transferred to the vial 950. The solvent is injected into the inclined vial 950, and therefore the solvent is suppressed from bubbling in the vial 950. As the solvent is injected into the vial 950, air inside the vial 950 flows into the drug solution bag 910 via the device 800.

Figure 8:
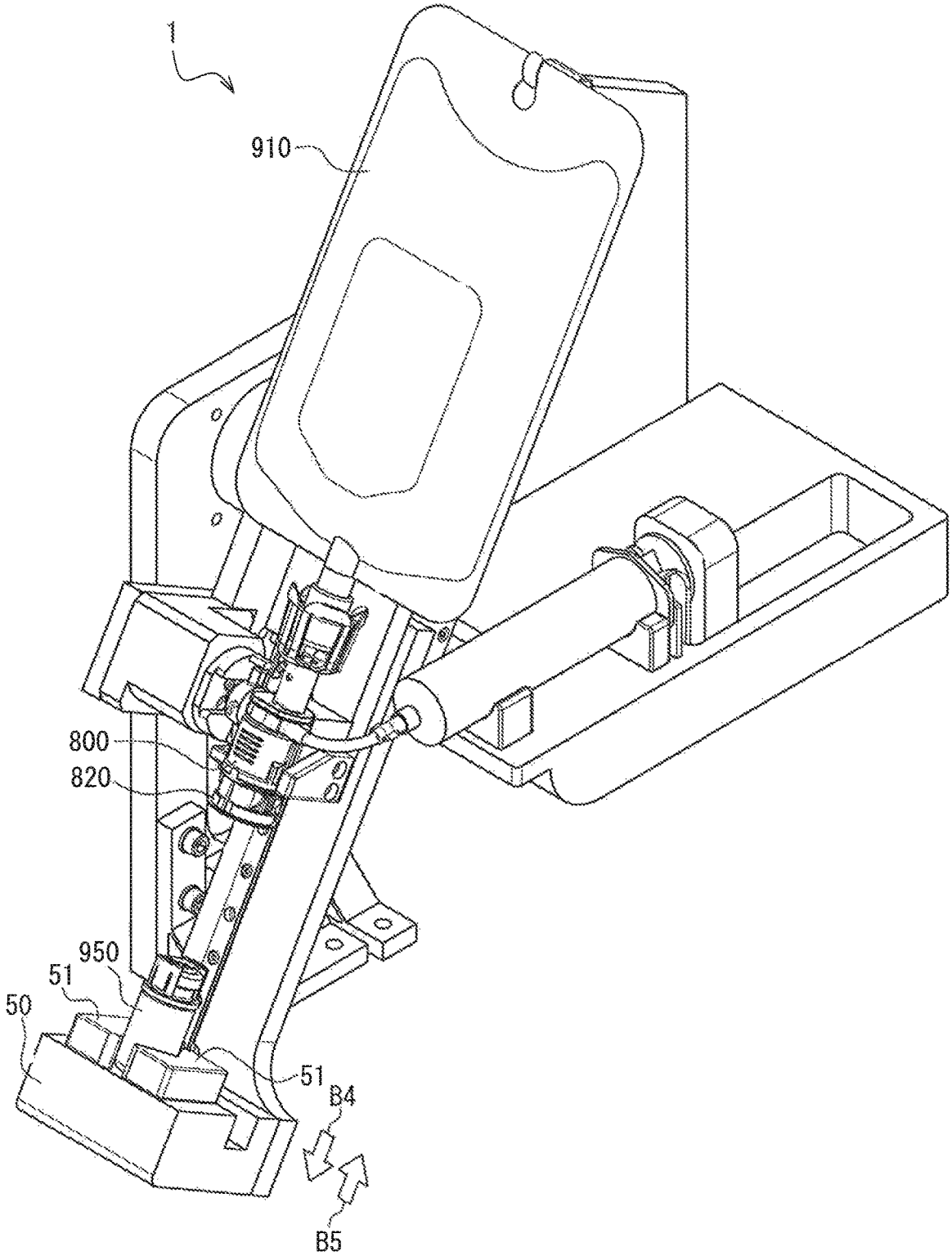
FIG. 8 is a perspective view showing a state in which the vial into which a solvent has been injected is separated from the transfer device in drug solution preparation performed using the drug solution preparation apparatus according to one embodiment of the present invention.

Next, as shown in FIG. 8, the vial holder 50 moves backward in the direction of an arrow B4 to extract the vial 950 from the second connector 820. As described above, the release button 827 (see FIG. 1) of the second connector 820 is in the pressed state, and accordingly the vial 950 can be separated from the second connector 820. Thereafter, the chucks 51 release the vial 950.

The vial 950 is taken out of the vial holder 50 and shaken to dissolve the powder drug contained in the vial 950 in the solvent. For example, the operator may take out the vial 950 from the vial holder 50, shake the vial 950, and return the vial 950 to the vial holder 50. Alternatively, the vial 950 may be shaken using a shaker (or vibrator) that vibrates the vial 950, and transferred between the vial holder 50 and the shaker by the operator or using a transfer apparatus (e.g., a robot). Alternatively, the vial 950 may be shaken using a transfer apparatus (e.g., a robot). As a result of the drug contained in the vial 950 being dissolved in the solvent, a drug solution is obtained.

The shaken vial 950 is returned to the vial holder 50. The chucks 51 securely hold the vial 950 again.

Next, the vial holder 50 moves forward in the direction of an arrow B5 to press the vial 950 into the second connector 820. The vial 950 is connected to the second connector 820 again.

Figure 9A:
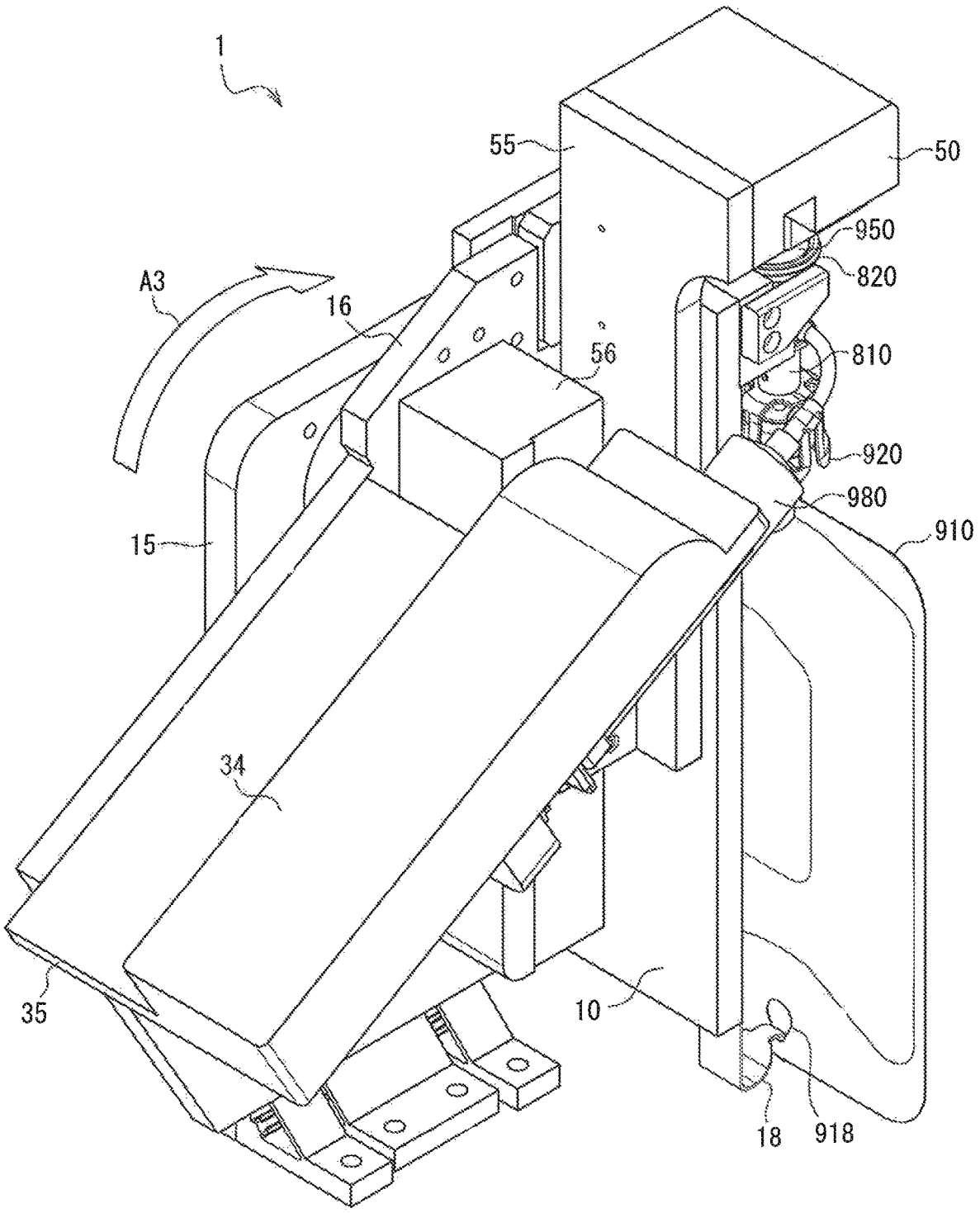
FIG. 9A is a perspective view showing a state in which the stage is turned to a second turning position in drug solution preparation performed using the drug solution preparation apparatus according to one embodiment of the present invention.
Figure 9B:
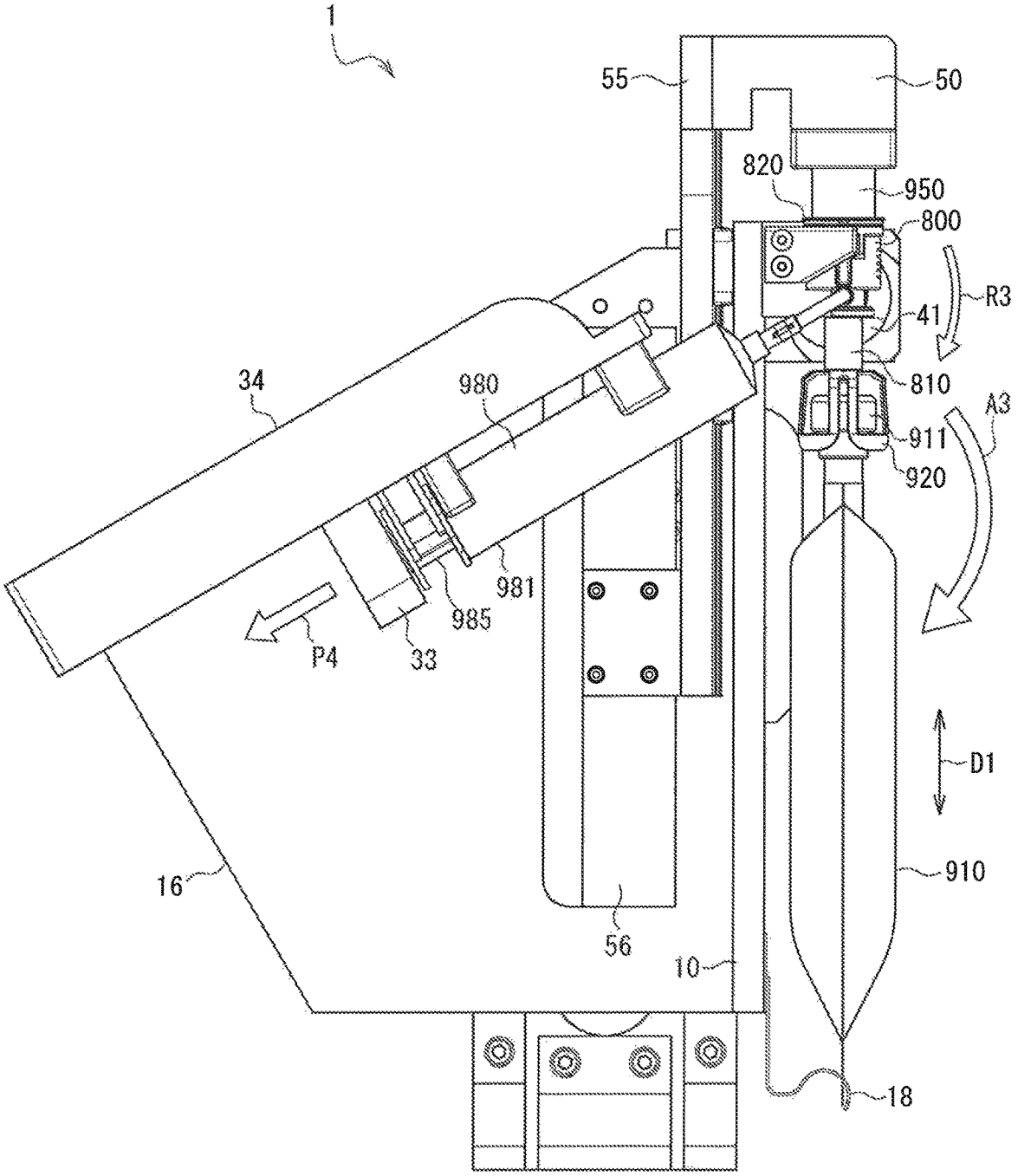
FIG. 9B is a side view of FIG. 9A.

Next, as shown in FIGS. 9A and 9B, the stage 10 is turned in the direction of an arrow A3 to the second turning position. Before the stage 10 is turned, the vial holder 50 is moved forward. The turning radius is reduced, and therefore the stage can be easily turned in the limited space inside the safety cabinet. The preparation apparatus 1 is substantially made compact by moving the vial holder 50 forward.

As most clearly shown in FIG. 9B, when the stage 10 is located at the second turning position, the first direction D1 of the stage 10 is parallel to the vertical direction. The second connector 820 is located higher than the first connector 810. The drug solution bag 910 enters an upright state in which the drug solution bag 910 is suspended by the device 800 with the port 911 being oriented upward. Air contained in the drug solution bag 910 gathers at the vicinity of the port 911. The longitudinal direction of the syringe 980 is inclined relative to the horizontal direction (i.e., is not parallel or perpendicular to the horizontal direction) such that the leading end of the syringe 980 is oriented diagonally upward.

Then, the plunger operating portion 33 moves in the direction of an arrow P4 to extract the plunger 985 from the outer cylinder 981. The drug solution contained in the vial 950 is collected into the syringe 980.

Figure 9C:
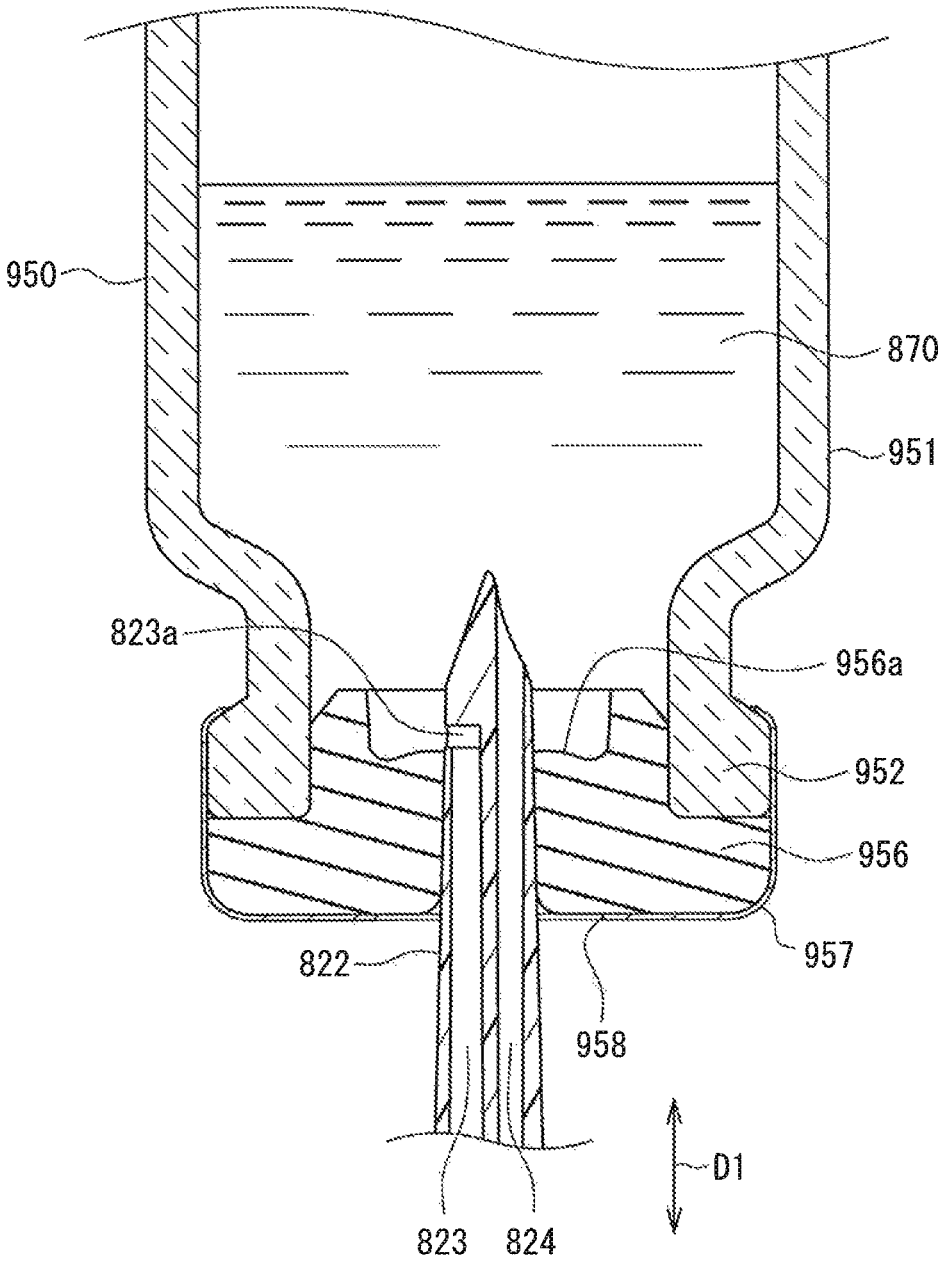
FIG. 9C is a cross-sectional view showing a second male member of the second connector that is stuck into a stopper body of the vial in the state shown in FIG. 9A.

FIG. 9C is an enlarged partial cross-sectional view showing a state in which the second male member 822 of the second connector 820 sticks into the stopper body 956 of the vial 950. In FIG. 9C, illustration of members other than the vial 950 and the second male member 822 is omitted to simplify the drawing. A cap 957 is attached to the stopper body 956 and the flange 952 to prevent the stopper body 956 from falling off from the bottle main body 951. The cap 957 is formed from a sheet of metal (e.g., aluminum), resin, etc. A center region of the stopper body 956 is exposed to the outside through a circular opening 958 that is provided in the cap 957. As described above, a liquid channel 823 and a gas channel 824 are provided independently of each other inside the second male member 822. The liquid channel 823 is in communication with a horizontal hole 823*a* in the vicinity of the leading end of the second male member 822. The horizontal hole 823*a* extends along a radial direction of the second male member 822 and is open in the outer circumferential surface of the second male member 822. The gas channel 824 extends along the longitudinal direction of the second male member 822 and is open in a tapered surface (conical surface) of the leading end of the second male member 822.

When the stage 10 is located at the second turning position, the vial 950 is vertically inverted (i.e., turned upside down) such that the stopper body 956 is oriented downward (see FIG. 9B) Accordingly, the drug solution 870 contained in the vial 950 gathers at the vicinity of the stopper body 956. The opening of the horizontal hole 823*a* and the opening of the gas channel 824 are both located above an inner surface 956*a* of the stopper body 956 and in the drug solution 870. The drug solution can be easily collected from the vial 950. As a result of the plunger 985 being extracted from the outer cylinder 981 (see the arrow P4 in FIG. 9B), the drug solution 870 flows from the horizontal hole 823*a* into the liquid channel 823, and air contained in the drug solution bag 910 flows from the gas channel 824 into the vial 950 in place of the drug solution 870.

If the horizontal hole 823*a* is located at a position that is significantly high relative to the inner surface 956*a* of the stopper body 956, all of the drug solution 870 contained in the vial 950 cannot be sucked from the horizontal hole 823*a*. It is desirable to control the insertion depth of the second male member 822 relative to the stopper body 956 so that the horizontal hole 823*a* is located at approximately the same position as the inner surface 956*a* of the stopper body 956. The insertion depth of the second male member 822 changes depending on the distance by which the vial holder 50 (i.e., the vial 950) is moved along the first direction D1 (i.e., the longitudinal direction of the second male member 822) by the linear driving mechanism 56. In the present embodiment, the position of the vial 950 in the first direction D1 is finely adjusted by the linear driving mechanism 56 in the state in which the stage 10 is located at the second turning position (see FIGS. 9A to 9C), such that the horizontal hole 823*a* is located at approximately the same position as the inner surface 956*a* of the stopper body 956. The position of the vial 950 may be finely adjusted while monitoring the horizontal hole 823*a* and the inner surface 956*a* of the stopper body 956 using a camera that is installed outside the vial 950, for example. Alternatively, the vial 950 may gradually be moved upward as the amount of the drug solution 870 contained in the vial 950 decreases. Note that the position of the vial 950 in the first direction D1 may be finely adjusted before the stage 10 is turned to the second turning position (see FIGS. 9A to 9C). The fine adjustment is an optional operation, and may be omitted.

Thus, approximately the entire amount of the drug solution 870 contained in the vial 950 is collected into the syringe 980.

Next, the rotor 41 of the stopcock operating portion 40 rotates in the direction of an arrow R3 to rotate the stopcock 840 to the first rotation position. Thus, the device 800 transitions to the first state in which the drug solution bag 910 is in communication with the syringe 980.

Figure 10:
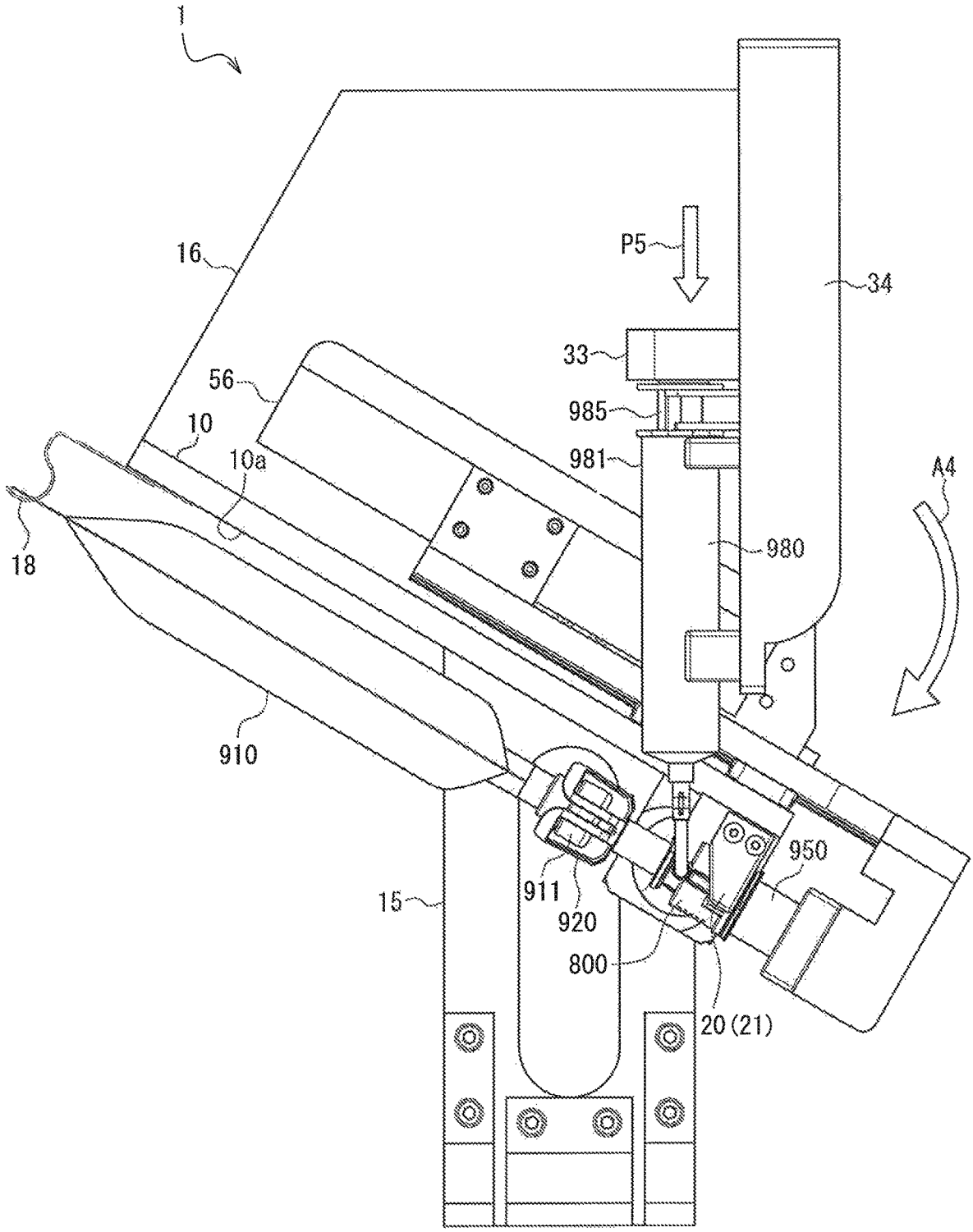
FIG. 10 is a side view showing a state in which the stage is turned to a fourth turning position in drug solution preparation performed using the drug solution preparation apparatus according to one embodiment of the present invention.

Next, as shown in FIG. 10, the stage 10 is turned in the direction of an arrow A4 to the fourth turning position. When the stage 10 is located at the fourth turning position, the syringe 980 is inverted with the leading end of the syringe 980 being oriented downward. The longitudinal direction of the syringe 980 is parallel to the vertical direction. The drug solution contained in the syringe 980 gathers at the vicinity of the leading end.

The drug solution bag 910 is located on the lower side of the stage 10. However, the device holder 20 holds the port 911 of the drug solution bag 910 via the device 800 and the adapter 920 and the hook 18 engages with the hole 918 (see FIG. 1) of the drug solution bag 910, and therefore the drug solution bag 910 is kept from falling from the stage 10 and held substantially along the placement surface 10*a*. The operator need not hold the drug solution bag 910.

The plunger operating portion 33 moves in the direction of an arrow P5 to press the plunger 985 into the outer cylinder 981. The drug solution contained in the syringe 980 is transferred to the drug solution bag 910. Even if air is contained in the syringe 980, the drug solution flows out first from the syringe 980. A desired amount of the drug solution can be transferred to the drug solution bag 910 by controlling the amount by which the plunger 985 is pressed into the outer cylinder 981.

There may be cases in which, even if the plunger 985 is pressed into the innermost end of the outer cylinder 981 in the state shown in FIG. 10, a portion of the drug solution is left in the channel from the syringe 980 to the drug solution bag 910 (i.e., the channel inside the device 800 (specifically, the connection port 850, the tube 852, the tubular portion 830, and the first connector 810) and the adapter 920) and cannot be transferred to the drug solution bag 910. Therefore, the following operation may be performed as necessary. This operation is effective in a case in which the entire amount of the drug solution contained in the syringe 980 is transferred to the drug solution bag 910, for example.

Figure 11:
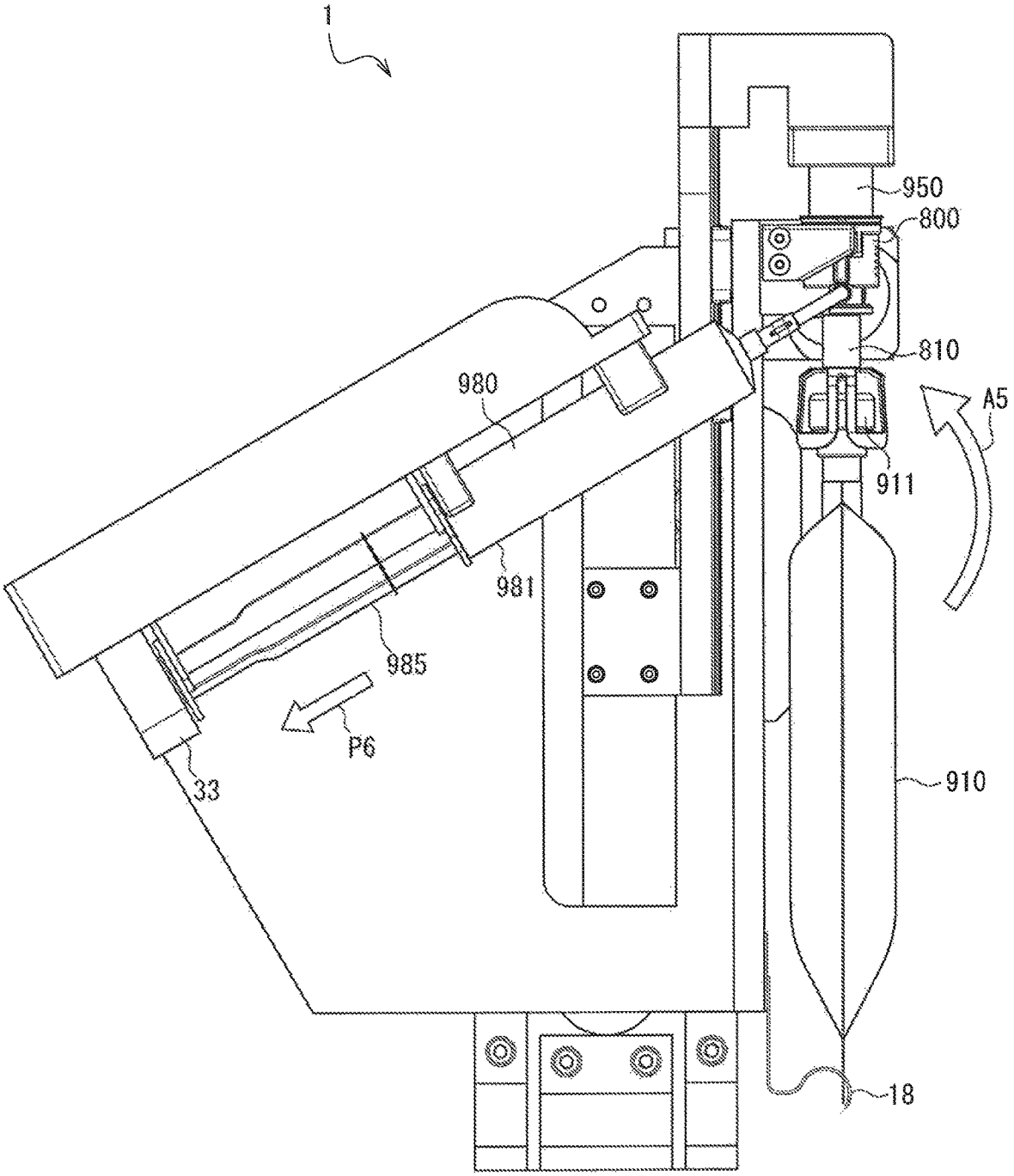
FIG. 11 is a side view showing a step in which the stage is turned to the second turning position and air is sucked into the syringe in drug solution preparation performed using the drug solution preparation apparatus according to one embodiment of the present invention.

First, the plunger 985 is pressed into the innermost end of the outer cylinder 981 in the state shown in FIG. 10 (the fourth turning position), and thereafter the stage 10 is turned in the direction of an arrow A5 to the second turning position as shown in FIG. 11. At the second turning position, the drug solution bag 910 is suspended with the port 911 (see FIG. 1) being located on the upper side. Air contained in the drug solution bag 910 gathers at the vicinity of the port 911. In this state, the plunger operating portion 33 moves in the direction of an arrow P6 to extract the plunger 985 from the outer cylinder 981. The drug solution left in the channel between the syringe 980 and the drug solution bag 910 returns to the syringe 980, and then a portion of air contained in the drug solution bag 910 is sucked into the syringe 980.

Next, the stage 10 is turned to the fourth turning position shown in FIG. 10 again. In the syringe 980, the drug solution gathers at the vicinity of the leading end, and air is located on the upper side of the drug solution. In this state, the plunger operating portion 33 moves in the direction of the arrow P5 to press the plunger 985 into the outer cylinder 981. First, the drug solution flows out from the syringe 980, and then the air flows out from the syringe 980. The air presses the drug solution left in the channel between the syringe 980 and the drug solution bag 910 toward the drug solution bag 910. Thus, the drug solution left in the above-described channel is replaced by the air.

The above-described sucking of air from the drug solution bag 910 into the syringe 980 (FIG. 11) and discharging of the drug solution and air from the syringe 980 toward the drug solution bag 910 (FIG. 10) are repeated as necessary. The entire amount of the drug solution contained in the syringe 980 can be injected into the drug solution bag 910 without leaving the drug solution in the channel from the syringe 980 to the drug solution bag 910.

Thereafter, the stage 10 is turned to the first turning position (see FIG. 6). The vial holder 50 is moved backward to extract the vial 950 from the second connector 820. The chucks 51 release the vial 950. The vial 950 is taken out from the vial holder 50.

The same operations as those described above may be performed with respect to another vial (second vial) 950, and a drug solution obtained by dissolving a drug contained in the second vial may be injected into the drug solution bag 910, as necessary.

When the drug solution preparation task is complete, the operator opens a glass door of the safety cabinet and removes the device 800 and the drug solution bag 910 from the stage 10. Further, the drug solution bag 910 is separated from the device 800. The drug solution bag 910 contains the drug solution in which a predetermined amount of the drug is dissolved.

4. Effects

As described above, the preparation apparatus 1 according to the present embodiment includes the stage 10 on which the device holder 20 for holding the device 800 is provided. The stage 10 can be turned at least to the first turning position where the first connector 810 (or the drug solution bag 910) is located higher than the second connector 820 (or the vial 950) (see FIGS. 2 to 4 and 6 to 8) and the second turning position where the second connector 820 (or the vial 950) is located higher than the first connector 810 (or the drug solution bag 910) (see FIGS. 9A to 9C and 11), so as to change the inclination of the stage 10. In a conventional drug solution preparation task performed using the device 800, the operator needs to perform an operation of changing the orientation of the device 800 while holding the device 800. The preparation apparatus 1 performs this operation instead of the operator. Therefore, the preparation apparatus 1 reduces the burden on the operator.

The preparation apparatus 1 includes the vial holder 50 that holds the vial 950 coaxially with the axis of the second connector 820 of the device 800 held by the device holder 20. The vial holder 50 turns together with the stage 10 about the rotation axis of the stage 10. The vial holder 50 can be linearly moved along the direction of the axis of the second connector 820 (i.e., the first direction D1 of the stage 10 or the direction of the axis of the vial 950). This is advantageous in terms of reducing the burden of the drug solution preparation task on the operator because the operator need not attach the vial 950 to the second connector 820 or detach the vial 950 from the second connector 820. Furthermore, the turning radius at the time of turning the stage 10 can be made small by moving the vial holder 50 forward, and this is advantageous in terms of making the preparation apparatus 1 compact. Furthermore, the insertion depth of the second male member 822 of the second connector 820 relative to the stopper body 956 of the vial 950 can be adjusted by moving the vial 950, irrespective of the turning position of the stage 10, and this is advantageous in terms of collecting all of the drug solution 870 contained in the vial 950 into the syringe 980.

In the present embodiment, the vial holder 50 turns together with the stage 10 about the rotation axis of the stage 10. Unlike the above-described embodiment, the present invention can also have a configuration in which the vial holder 50 and the linear driving mechanism 56 of the vial holder 50 are provided on, for example, the base plate (not shown) on which the support 15 is provided, such that the vial holder 50 and the linear driving mechanism 56 do not turn together with the stage 10. However, in this case, the vial holder 50 and the linear driving mechanism 56 need to be arranged apart from the stage 10 and a structure (e.g., the syringe stage 35) that turns together with the stage 10, so as not to collide with the stage 10 and the structure. This increases the size of the preparation apparatus. Furthermore, the insertion depth of the second male member 822 relative to the stopper body 956 cannot be adjusted in a state in which the vial 950 is inverted as described with reference to FIG. 9C. Furthermore, the stage 10 needs to be positioned at a predetermined turning position to connect the vial 950 to the second connector 820 and separate the vial 950 from the second connector 820. The present embodiment in which the vial holder 50 and the linear driving mechanism 56 turn together with the stage 10 is advantageous in terms of making the preparation apparatus 1 compact, adjusting the insertion depth of the second male member 822 relative to the stopper body 956, and making it possible to connect the vial 950 to and separate the vial 950 from the second connector 820 irrespective of the turning position of the stage 10.

In the present embodiment, when the stage 10 is located at the second turning position (see FIGS. 9A to 9C and 11), the vial 950 is moved along the direction of the axis of the second connector 820 (i.e., the first direction D1 of the stage 10 or the direction of the axis of the vial 950). This enables adjustment of the insertion depth of the second male member 822 relative to the stopper body 956, and therefore is advantageous in terms of collecting all of the drug solution 870 contained in the vial 950 into the syringe 980.

In the present embodiment, the linear driving mechanism 56 that linearly moves the vial holder 50 is arranged on the side of the stage 10 that is opposite to the side (the placement surface 10*a* side) on which the device holder 20 is provided. This is advantageous in terms of making the preparation apparatus 1 compact by keeping the size of the preparation apparatus 1 from increasing as a result of providing the linear driving mechanism 56.

Note that, unlike the present embodiment, a configuration is also possible in which the preparation apparatus 1 does not include the vial holder 50. In this case, the vial 950 can be attached to and detached from the second connector 820 by the operator or by using a transfer apparatus (e.g., a robot).

The entire syringe 980 substantially has a rod shape and is long in its longitudinal direction so that the plunger 985 can be inserted into or extracted from the syringe 980. In the preparation apparatus 1, the syringe holder 30 holds the syringe 980 (specifically, the outer cylinder 981) such that the longitudinal direction of the syringe 980 is perpendicular to the direction of the rotation axis of the stage 10. This configuration can reduce the length of the entire preparation apparatus 1 including the syringe 980 along the rotation axis. This is advantageous in terms of making the preparation apparatus 1 compact. The preparation apparatus 1 can be installed in a limited space inside the safety cabinet to perform the drug solution preparation task. If the preparation apparatus 1 is housed in the safety cabinet, the possibility of the drug leaking to the outside decreases, and this is advantageous when preparing a drug solution using a dangerous drug, such as an anticancer drug, in terms of preventing the operator from being exposed to the drug.

Note that, unlike the present embodiment, a configuration is also possible in which the syringe holder 30 holds the syringe 980 (specifically, the outer cylinder 981) such that the longitudinal direction of the syringe 980 is parallel to the direction of the rotation axis of the stage 10. For example, the syringe holder 30 may also hold the syringe 980 coaxially with the tubular portion 930.

In the present embodiment, the syringe holder 30 holds the syringe 980 such that the longitudinal direction of the syringe 980 is inclined (i.e., is not parallel or perpendicular) relative to the first direction D1 of the stage 10 (i.e., the direction of the axis of the first connector 810 and the direction of the axis of the second connector 820). Unlike the present embodiment, the syringe holder 30 can be provided, for example, on the placement surface 10*a* of the stage 10 such that the longitudinal direction of the syringe 980 is parallel to the first direction D1. In this case, the syringe 980 and the syringe holder 30 need to be arranged so as not to collide with the drug solution bag 910 placed on the placement surface 10*a*, and this increases the length (width) of the preparation apparatus 1 along the rotation axis of the stage 10. The present embodiment in which the longitudinal direction of the syringe 980 is inclined relative to the first direction D1 is advantageous in terms of reducing the width of the preparation apparatus 1.

As shown in FIG. 10, the preparation apparatus 1 according to the present embodiment is configured such that the syringe holder 30 can hold the syringe 980 in a state (inverted state) in which the syringe 980 is inverted and the leading end of the syringe 980 is oriented downward. After the drug solution is sucked from the vial 950 into the syringe 980, if the syringe 980 is held in the inverted state and the plunger 985 is pressed into the outer cylinder 981, the drug solution always flows out first from the syringe 980. In a case in which only a portion of the drug solution contained in the syringe 980 is transferred to the drug solution bag 910, a desired amount of the drug solution can be transferred to the drug solution bag 910 by controlling the amount by which the plunger 985 is pressed into the outer cylinder 981. In a case in which the entire amount of the drug solution contained in the syringe 980 is transferred to the drug solution bag 910, the stage 10 is turned to the second turning position, air is sucked from the drug solution bag 910 into the syringe 980 (see FIG. 11), and thereafter the syringe 980 is held in the above-described inverted state and the plunger 985 is pressed into the outer cylinder 981 (see FIG. 10). Thus, the drug solution can be injected into the drug solution bag 910 without leaving the drug solution in the channel from the syringe 980 to the drug solution bag 910. As described above, a desired amount of the drug solution can be accurately injected into the drug solution bag 910. Therefore, the above-described configuration is advantageous in terms of suppressing a preparation error of the drug solution.

As shown in FIGS. 5A and 5B, the preparation apparatus 1 according to the present embodiment is configured such that the syringe holder 30 can hold the syringe 980 in a state (upright state) in which the syringe 980 is upright and the leading end of the syringe 980 is oriented upward. After the solvent is sucked from the drug solution bag 910 into the syringe 980, if the syringe 980 is held in the upright state and the plunger 985 is pressed into the outer cylinder 981, air is discharged from the syringe 980. Therefore, the solvent contained in the syringe 980 can be accurately measured as desired. As a result, the drug contained in the vial 950 can be dissolved in an accurate amount of the solvent. Therefore, the above-described configuration is advantageous in terms of suppressing a preparation error of the drug solution.

In the present embodiment, the syringe holder 30 turns together with the stage 10 about the rotation axis of the stage 10. Therefore, even if the stage 10 turns, the tube 852 connecting the tubular portion 830 and the syringe 980 to each other is not twisted. Furthermore, the orientation of the syringe 980 can be changed to the upright state and/or the inverted state as described above using the mechanism for turning the stage 10. This is advantageous in terms of simplifying the configuration of the preparation apparatus 1.

Note that, unlike the present embodiment, a configuration is also possible in which the preparation apparatus 1 does not include the syringe holder 30. In this case, the stage 10 may be turned while the syringe 980 is held by the operator.

In the present embodiment, the stage 10 (specifically, the first direction D1 thereof) is inclined when the stage 10 is located at the first turning position (see FIGS. 2 to 4 and 6 to 8). It goes without saying that, unlike the present embodiment, the present invention may also have a configuration in which the stage 10 is parallel to the vertical direction or the horizontal direction when the stage 10 is located at the first turning position, for example. In these cases, the height or the depth of the preparation apparatus 1 needs to be increased to realize a configuration in which the vial holder 50 turns together with the stage 10 and can be moved toward or away from the device 800, similarly to the present embodiment. Furthermore, if the stage 10 is upright in parallel to the vertical direction, it is difficult to attach the device 800 and the drug solution bag 910 to the preparation apparatus 1 or detach the device 800 and the drug solution bag 910 from the preparation apparatus 1. The present embodiment in which the stage 10 located at the first turning position is inclined is advantageous in terms of reducing the height and the depth of the preparation apparatus 1 and making it easy to perform operations for attaching the device 800 and the drug solution bag 910 to the preparation apparatus 1 and detaching the device 800 and the drug solution bag 910 from the preparation apparatus 1 in a state in which the stage 10 is located at the first turning position.

In the present embodiment, when the stage 10 is located at the second turning position (see FIGS. 9A to 9C and 11), the vial 950 is in an inverted state in which the stopper body 956 sealing the opening of the vial 950 is oriented downward, and the drug solution bag 910 is in the upright state in which the port 911 of the drug solution bag 910 is oriented upward. Arranging the vial 950 in the inverted state is advantageous in terms of collecting the drug solution from the vial 950 into the syringe 980. Arranging the drug solution bag 910 in the upright state is advantageous in terms of sucking air from the drug solution bag 910.

The preparation apparatus 1 according to the present embodiment includes the plunger operating portion 33 for inserting the plunger 985 into and extracting the plunger 985 from the outer cylinder 981 of the syringe 980. The plunger operating portion 33 causes a liquid (the solvent or the drug solution) to be transferred between the drug solution bag 910 and the syringe 980 in the first state in which the drug solution bag 910 is in communication with the syringe 980, and causes a liquid (the solvent or the drug solution) to be transferred between the vial 950 and the syringe 980 in the second state in which the vial 950 is in communication with the syringe 980. The plunger operating portion 33 eliminates the need for the plunger 985 to be inserted and extracted by the operator, and this is advantageous in terms of reducing the burden of the drug solution preparation task on the operator.

Note that, unlike the present embodiment, a configuration is also possible in which the preparation apparatus 1 does not include the plunger operating portion 33. In this case, the plunger 985 may be inserted and extracted by the operator.

In the present embodiment, the stage 10 includes a mechanism (a drug solution bag holding mechanism) for holding the drug solution bag 910 so as not to separate from the stage 10 when the stage 10 is turned such that the drug solution bag 910 connected to the first connector 810 is located below the stage 10 (i.e., the fourth turning position shown in FIG. 10). The drug solution bag holding mechanism holds the drug solution bag 910, which is heavy and easily deformable, such that the drug solution bag 910 extends along the stage 10 without the shape of the drug solution bag 910 largely deforming. This eliminates the need for the drug solution bag 910 to be held by the operator, and therefore is advantageous in terms of reducing the burden on the operator. In the present embodiment, the drug solution bag holding mechanism is the hook 18 configured to be inserted into the hole 918 of the drug solution bag 910, but the drug solution bag holding mechanism is not limited to this configuration and may have any configuration. For example, the drug solution bag holding mechanism may be a band (e.g., an elastic band) that can fix the drug solution bag 910 to the stage 10 or a container that can house the drug solution bag 910. The container may have any configuration, such as a bag that is constituted by a soft net or sheet, or a box that is constituted by a hard material (e.g., resin or metal).

Note that, unlike the present embodiment, a configuration is also possible in which the preparation apparatus 1 does not include the drug solution bag holding mechanism. The drug solution bag holding mechanism can be omitted if the stage 10 does not turn to the fourth turning position (see FIG. 10) or the drug solution bag 910 is small or unlikely to deform, for example.

The preparation apparatus 1 according to the present embodiment includes the rotation driving apparatus 17 that turns the stage 10. The rotation driving apparatus 17 eliminates the need for the stage 10 on which the device 800 is mounted to be turned by the operator, and this is advantageous in terms of reducing the burden of the drug solution preparation task on the operator.

Note that, unlike the present embodiment, a configuration is also possible in which the preparation apparatus 1 does not include the rotation driving apparatus 17. In this case, the stage 10 can be turned by the operator to change the orientation of the device 800.

The preparation apparatus 1 according to the present embodiment includes the stopcock operating portion 40 for rotating the stopcock 840. The stopcock operating portion 40 switches the channels inside the device 800 between the first state and the second state. The stopcock operating portion 40 eliminates the need for the stopcock 840 to be rotated by the operator, and this is advantageous in terms of reducing the burden of the drug solution preparation task on the operator.

Note that, unlike the present embodiment, a configuration is also possible in which the preparation apparatus 1 does not include the stopcock operating portion 40. In this case, the stopcock 840 may be rotated by the operator to switch the channels inside the device 800 between the first state and the second state.

In the present embodiment, the controller controls the rotation driving apparatus 17, the plunger driving mechanism 34 of the plunger operating portion 33, the driving mechanism 42 of the stopcock operating portion 40, the vial holder 50, and the linear driving mechanism 56. The preparation apparatus 1 can be configured to automatically perform many steps that are necessary to prepare a drug solution using the device 800. This further reduces the burden of the drug solution preparation task on the operator.

However, the preparation apparatus according to the present invention may also be constituted only by the stage 10 that can be turned to the first turning position and the second turning position and the vial holder 50 that can be moved along the first direction D1. In the case of this simplified preparation apparatus, the operator turns the stage 10, inserts and extracts the plunger 985, and rotates the stopcock 840.

Alternatively, the preparation apparatus according to the present invention may also be constituted only by the stage 10 that can be turned to the first turning position and the second turning position and the syringe holder 30. In the case of this simplified preparation apparatus, the operator turns the stage 10, inserts and extracts the plunger 985, rotates the stopcock 840, and attaches the vial 950 to and detaches the vial 950 from the second connector 820.

INDUSTRIAL APPLICABILITY

Although there is no limitation on fields in which the present invention can be used, the present invention can be widely used in medical fields, in particular, fields in which a drug solution is prepared by dissolving a drug in the form of powder. Although there is no limitation on the type of drug, the present invention is suitable for dangerous drugs, such as anticancer drugs, that may pose a danger when exposed thereto.

DESCRIPTION OF REFERENCE NUMERALS

1 Drug solution preparation apparatus
10 Stage
17 Rotation driving apparatus
18 Hook (mechanism for holding first container)
20 Device holder
30 Syringe holder
33 Plunger operating portion
40 Stopcock operating portion
50 Vial holder (second container holder)
56 Linear driving mechanism of vial holder
800 Transfer device
810 First connector
820 Second connector
840 Stopcock
850 Connection port
910 Drug solution bag (first container)
911 Port
950 Vial (second container)
956 Stopper body
980 Syringe
985 Plunger

The invention claimed is:

1. A drug solution preparation apparatus comprising:

a device holder configured to hold a transfer device that includes a first connector to which a first container is connectable, a second connector to which a second container is connectable, and a connection port to which a syringe is connectable, the transfer device being switchable between a first state in which the first connector and the connection port are in communication with each other and a second state in which the second connector and the connection port are in communication with each other;

a stage on which the device holder is provided; and a second container holder configured to hold the second container coaxially with an axis of the second connector of the transfer device held by the device holder, wherein the stage can be turned to a first turning position where the first connector is located higher than the second connector and a second turning position where the second connector is located higher than the first connector, so as to change an inclination of the stage, the second container holder turns together with the stage about a rotation axis of the stage, and the second container holder can be linearly moved along a direction of the axis of the second connector.

2. The drug solution preparation apparatus according to claim 1, wherein the second container is moved along the direction of the axis of the second connector when the stage is located at the second turning position.

3. The drug solution preparation apparatus according to claim 1, further comprising a linear driving mechanism configured to linearly move the second container holder, wherein the linear driving mechanism is arranged on a side that is opposite to a side of the stage on which the device holder is provided.

4. The drug solution preparation apparatus according to claim 1, further comprising a syringe holder configured to hold the syringe, wherein the syringe holder holds the syringe such that a longitudinal direction of the syringe is perpendicular to a direction of the rotation axis of the stage.

5. The drug solution preparation apparatus according to claim 4, wherein the syringe holder holds the syringe such that the longitudinal direction of the syringe is inclined relative to a direction of an axis of the first connector and a direction of an axis of the second connector.

6. The drug solution preparation apparatus according to claim 4, wherein the syringe holder is configured to hold the syringe in a state in which the syringe is inverted and a leading end of the syringe is oriented downward.

7. The drug solution preparation apparatus according to claim 4, wherein the syringe holder is configured to hold the syringe in a state in which the syringe is upright and a leading end of the syringe is oriented upward.

8. The drug solution preparation apparatus according to claim 4, wherein the syringe holder turns together with the stage about the rotation axis of the stage.

9. The drug solution preparation apparatus according to claim 1, wherein, when the stage is located at the first turning position, the stage is inclined.

10. The drug solution preparation apparatus according to claim 1, wherein, when the stage is located at the second turning position, the second container is in an inverted state in which a stopper body that seals an opening of the second container is oriented downward, and the first container is in an upright state in which a port of the first container is oriented upward.

11. The drug solution preparation apparatus according to claim 1, further comprising a plunger operating portion configured to insert a plunger into an outer cylinder of the syringe and extract the plunger from the outer cylinder of the syringe.

12. The drug solution preparation apparatus according to claim 1, wherein the stage includes a mechanism for holding the first container so as not to separate from the stage when the stage is turned such that the first container connected to the first connector is located below the stage.

13. The drug solution preparation apparatus according to claim 1, further comprising a rotation driving apparatus configured to turn the stage.

14. The drug solution preparation apparatus according to claim 1, further comprising a stopcock operating portion for rotating a stopcock that is provided in the transfer device, wherein the stopcock operating portion rotates the stopcock such that a channel inside the transfer device is switched between the first state and the second state.

15. The drug solution preparation apparatus according to claim 1, wherein the first container is an easily deformable container in which a liquid is contained.

16. The drug solution preparation apparatus according to claim 1, wherein the second container is a vial in which a drug in the form of powder is enclosed.

17. A drug solution preparation apparatus comprising:

a device holder configured to hold a transfer device that includes a first connector to which a first container is connectable, a second connector to which a second container is connectable, and a connection port to which a syringe is connectable, the transfer device being switchable between a first state in which the first connector and the connection port are in communication with each other and a second state in which the second connector and the connection port are in communication with each other;

a stage on which the device holder is provided; and a syringe holder configured to hold the syringe, wherein the stage can be turned to a first turning position where the first connector is located higher than the second connector and a second turning position where the second connector is located higher than the first connector, so as to change an inclination of the stage, and the syringe holder holds the syringe such that a longitudinal direction of the syringe is perpendicular to a direction of a rotation axis of the stage.

18. The drug solution preparation apparatus according to claim 17, further comprising a second container holder configured to hold the second container, wherein the second container holder holds the second container coaxially with an axis of the second connector of the transfer device held by the device holder, and the second container holder linearly moves along a direction of the axis of the second connector.

19. The drug solution preparation apparatus according to claim 18, wherein the second container holder turns together with the stage about the rotation axis of the stage.

* * * * *